US008038245B2

(12) United States Patent
Iwao et al.

(10) Patent No.: US 8,038,245 B2
(45) Date of Patent: Oct. 18, 2011

(54) INK JET PRINTER, METHOD OF CONTROLLING AN INK JET PRINTER, AND COMPUTER PROGRAM PRODUCT FOR AN INK JET PRINTER

(75) Inventors: Naoto Iwao, Nagoya (JP); Shin Ishikura, Kokubu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 289 days.

(21) Appl. No.: 11/260,162

(22) Filed: Oct. 28, 2005

(65) Prior Publication Data

US 2006/0092196 A1 May 4, 2006

(30) Foreign Application Priority Data

Oct. 29, 2004 (JP) ..... 2004-315858

(51) Int. Cl.
*B41J 29/38* (2006.01)

(52) U.S. Cl. ..... 347/13

(58) Field of Classification Search ..... 347/13
See application file for complete search history.

(56) References Cited

U.S. PATENT DOCUMENTS 4,672,398 A * 6/1987 Kuwabara et al. ..... 347/11
5,402,159 A 3/1995 Takahashi et al.
5,734,398 A 3/1998 Mitani
6,280,012 B1 8/2001 Schloeman et al.
6,328,397 B1 12/2001 Shimizu
6,390,581 B1 5/2002 Lee et al.
6,543,879 B1 * 4/2003 Feinn et al. ..... 347/40
6,616,258 B2 9/2003 Maeda
2002/0101465 A1 8/2002 Maeda
2003/0081027 A1 5/2003 Feinn et al.
2003/0156167 A1 8/2003 Sakaida et al.

(Continued)

FOREIGN PATENT DOCUMENTS

EP 1 506 862 2/2005

(Continued)

OTHER PUBLICATIONS

European Search Report, mailed Mar. 21, 2007, application No. 05023695.9.

(Continued)

*Primary Examiner* — Julian D Huffman
(74) *Attorney, Agent, or Firm* — Banner & Witcoff, Ltd

(57) ABSTRACT

A printer is provided with an ink jet head and a controller. The ink jet head prints on a print medium by discharging ink. The ink jet head comprises a plurality of units. Each unit comprises a nozzle for discharging ink, a pressure chamber communicating with the nozzle, and a piezoelectric element facing the pressure chamber. The piezoelectric elements form at least two element lines. Each element line is formed by at least two piezoelectric elements aligned in a first direction. Each element line is aligned in a sec direction which is different from the first direction. The controller controls the ink jet head to print on the print medium by changing voltage applied to each piezoelectric element of the ink jet head. The controller controls timings at which the controller changes voltage applied to each piezoelectric element by the element line. It is preferred that a timing at which the controller changes voltage applied to one of the two adjacent element lines is different from a timing at which the controller changes voltage applied to the other of the two adjacent element lines.

11 Claims, 19 Drawing Sheets

U.S. PATENT DOCUMENTS

| | | | | |
|---|---|---|---|---|
| 2004/0080568 | A1 | 4/2004 | Matsuo et al. | |
| 2004/0201638 | A1 | 10/2004 | Imai | |
| 2004/0218018 | A1 | 11/2004 | Sakaida et al. | |
| 2005/0024427 | A1 | 2/2005 | Matsuo et al. | |
| 2005/0024428 | A1 | 2/2005 | Matsuo et al. | |
| 2005/0073537 | A1 * | 4/2005 | Iwao | 347/11 |
| 2005/0185028 | A1 | 8/2005 | Sakaida et al. | |
| 2006/0055717 | A1 | 3/2006 | Hirota | |

FOREIGN PATENT DOCUMENTS

| | | | |
|---|---|---|---|
| EP | 1 634 705 | | 3/2006 |
| JP | 7-89071 | | 4/1995 |
| JP | 7-304174 | A | 11/1995 |
| JP | 8-164602 | A | 6/1996 |
| JP | 10-315451 | | 12/1998 |
| JP | 2000-168069 | A | 6/2000 |
| JP | 2001-113697 | A | 4/2001 |
| JP | 2002-225265 | A | 8/2002 |
| JP | 2002-301816 | A | 10/2002 |
| JP | 3348738 | | 11/2002 |
| JP | 2003-145771 | A | 5/2003 |
| JP | 2003-170594 | A | 6/2003 |
| JP | 2004-160966 | A | 6/2004 |
| JP | 2004-299252 | A | 10/2004 |
| JP | 2006-082259 | A | 3/2006 |

OTHER PUBLICATIONS

CN Office Action Dec. 7, 2007, CN App. 200510118574 (concise explanation of relevant portions included).

JP Office Action mailed Mar. 30, 2010, JP Appln. 2004-315858, partial English Translation.

EP Office Action dtd Dec. 2, 2009, EP Appln. 05023695.9.

JP Office Action dtd Jul. 6, 2010, JP Appln. 2004-315858, English translation.

Notification of Reasons for Rejection in Japanese Application No. 2004-315858, mailed Oct. 19, 2010 and English translation thereof.

JP Office Action dtd Apr. 26, 2011, JP Appln. 2004-315858, English Translation.

JP Decision to Dismiss the Amendment dtd Apr. 26, 2011, JP Appln. 2004-315858, English Translation.

* cited by examiner

| Ink Chamber | Pressure Chamber Line | Nozzle Line | Projective Point | Element Line | Delay |
|---|---|---|---|---|---|
| E1 | F1 (11b) | F1' (15b) | (1) | G1 (20b) | 0 |
| E1 | F2 (11a) | F2' (15a) | (9) | G2 (20a) | 1 |
| E1 | F3 (11d) | F3' (15d) | (13) | G3 (20d) | 2 |
| E1 | F4 (11c) | F4' (15c) | (5) | G4 (20c) | 3 |
| E2 | F5 (11b) | F5' (15b) | (15) | G5 (20b) | 0 |
| E2 | F6 (11a) | F6' (15a) | (7) | G6 (20a) | 1 |
| E2 | F7 (11d) | F7' (15d) | (11) | G7 (20d) | 2 |
| E2 | F8 (11c) | F8' (15c) | (3) | G8 (20c) | 3 |
| E3 | F9 (11a) | F9' (15a) | (16) | G9 (20a) | 1 |
| E3 | F10 (11b) | F10' (15b) | (8) | G10 (20b) | 0 |
| E3 | F11 (11c) | F11' (15c) | (12) | G11 (20c) | 3 |
| E3 | F12 (11d) | F12' (15d) | (4) | G12 (20d) | 2 |
| E4 | F13 (11a) | F13' (15a) | (14) | G13 (20a) | 1 |
| E4 | F14 (11b) | F14' (15b) | (6) | G14 (20b) | 0 |
| E4 | F15 (11c) | F15' (15c) | (10) | G15 (20c) | 3 |
| E4 | F16 (11d) | F16' (15d) | (2) | G16 (20d) | 2 |

FIG. 11

| Projective Point | Ink Chamber | Nozzle Line | Delay |
|---|---|---|---|
| (1) | E1 | F1' (15b) | 0 |
| (2) | E4 | F16' (15d) | 2 |
| (3) | E2 | F8' (15c) | 3 |
| (4) | E3 | F12' (15d) | 2 |
| (5) | E1 | F4' (15c) | 3 |
| (6) | E4 | F14' (15b) | 0 |
| (7) | E2 | F6' (15a) | 1 |
| (8) | E3 | F10' (15b) | 0 |
| (9) | E1 | F2' (15a) | 1 |
| (10) | E4 | F15' (15c) | 3 |
| (11) | E2 | F7' (15d) | 2 |
| (12) | E3 | F11' (15c) | 3 |
| (13) | E1 | F3' (15d) | 2 |
| (14) | E4 | F13' (15a) | 1 |
| (15) | E2 | F5' (15b) | 0 |
| (16) | E3 | F9' (15a) | 1 |

INK JET PRINTER, METHOD OF CONTROLLING AN INK JET PRINTER, AND COMPUTER PROGRAM PRODUCT FOR AN INK JET PRINTER

CROSS-REFERENCE TO RELATED APPLICATION

This application claims priority to Japanese Patent Application No. 2004-315858, filed on Oct. 29, 2004, the contents of which are hereby incorporated by reference into the present application.

BACKGROUND OF THE INVENTION

1. Field of the Invention

The present invention relates to an ink jet printer. The present invention further relates to a method for controlling an ink jet printer, and a computer program product for an ink jet printer. The ink jet printer of the present invention includes all devices for printing words, images, etc. by discharging ink towards a print medium. For example, the ink jet printer of the present invention includes copying machines, fax machines, etc.

2. Description of the Related Art

An ink jet printer has an ink jet head for printing on a print medium by means of discharging ink. Some ink jet heads have a plurality of units. Each unit has a nozzle for discharging ink, a pressure chamber communicating with the nozzle, and a piezoelectric element facing the pressure chamber. When the piezoelectric element is deformed toward a pressure chamber, capacity of the pressure chamber decreases. Then the ink within the pressure chamber is pressurized, and the pressurized ink is discharged from the nozzle.

Selection of the piezoelectric element of which voltage is to be changed causes a selection of the pressure chamber within which the pressure is to be changed. The selection of the pressure chamber within which the pressure is to be changed causes a selection of the nozzle from which ink is to be discharged. In the ink jet head with the above configuration, ink can be discharged from a desired nozzle by changing the voltage of a selected piezoelectric element. An ink jet printer having this type of ink jet head is taught in U.S. Pat. No. 5,402,159.

In the above type of ink jet head, the piezoelectric elements are disposed in a matrix shape within a predetermined plane. Here, the piezoelectric elements aligned in a first direction in the predetermined plane will be termed an element line. Each element line is aligned in a second direction which is different from the first direction.

Each piezoelectric element faces a corresponding pressure chamber. Consequently, the pressure chambers are also disposed in a matrix shape. Here, the pressure chambers aligned in the first direction will be termed a pressure chamber line. Each pressure chamber line is aligned in the second direction.

The nozzles are also disposed in a matrix shape. Here, the nozzles aligned in the first direction will be termed a nozzle line. Each nozzle line is aligned in the second direction. The nozzles that are disposed in the matrix shape are mutually offset in the first direction. The units having the piezoelectric elements that are included in the same element line have the nozzles that are included in the same nozzle line.

FIG. 20 is a simplified view showing an example of an arrangement of the element lines and the nozzle lines. Four element lines X1 to X4 are formed in FIG. 20. One element line consists of four piezoelectric elements aligned in the first direction. Sixteen piezoelectric elements are disposed in a matrix shape. One nozzle corresponds to one piezoelectric element. Four nozzle lines Y1 to Y4 are formed. Each of the sixteen nozzles is mutually offset in the first direction.

In this example, a print medium (for example, a print sheet) is moved at a uniform speed in the second direction. If a straight line Z1 and a straight line Z2 are to be printed on the print medium, the following operation is performed. The distance between the straight line Z1 and the straight line Z2 is equal to the distance between two adjacent nozzle lines (for example, Y1 and Y2). The print medium is moved in the second direction firm the state shown in FIG. 20. When the nozzle line Y1 is facing the position where the straight line Z1 is to be printed, all of the piezoelectric elements in the element line X1 are simultaneously deformed. Ink is thus simultaneously discharged from the four nozzles in the nozzle line Y1. Next, when the nozzle line Y2 is facing the position where the straight line Z1 is to be printed (when the nozzle line Y1 is facing the position where the straight line Z2 is to be printed), the piezoelectric elements in the element line X1 and the piezoelectric elements in the element line X2 are simultaneously deformed. Ink is thus simultaneously discharged from the nozzles in the nozzle line Y1 and the nozzles in the nozzle line Y2. Next, when the nozzle line Y3 is facing the position where the straight line Z1 is to be printed, the piezoelectric elements in the element line X2 and the piezoelectric elements in the element line X3 are simultaneously deformed. Next, when the nozzle line Y4 is facing the position where the straight line Z1 is to be printed, the piezoelectric elements in the element line X3 ad the piezoelectric elements in the element line X4 are simultaneously deformed. Finally, when the nozzle line Y4 is facing the position where the straight line Z2 is to be printed, the piezoelectric elements in the element line X4 are simultaneously deformed. The two straight lines Z1 and Z2 are thus printed on the print medium.

The piezoelectric elements may be formed from a common piezoelectric sheet that extends across the plurality of pressure chambers. The following phenomenon may occur if this type of common piezoelectric sheet is used. When only one of two adjacent piezoelectric elements is deformed, the other adjacent piezoelectric element may also be deformed. In the present specification, the phenomenon in which the deformation of one piezoelectric element affects the degree of deformation of a piezoelectric element adjacent thereto is termed a structural cross-talk phenomenon. When there is deformation of a piezoelectric element in which deformation was not desired, ink may be discharged from an untended nozzle, or ink may be discharged with an unintended timing. In this case, satisfactory printing results cannot be achieved.

The structural cross-talk phenomenon has an effect not only in the case where only one of two adjacent piezoelectric elements is deformed, but also has an effect in the following case. As in the aforementioned example of FIG. 20, ink may be discharged simultaneously from two adjacent nozzles in the ink jet printer. The two adjacent piezoelectric elements may be simultaneously deformed in the same direction. In this case, one of the two adjacent piezoelectric elements may have a smaller degree of deformation than in the case where only one of the two adjacent piezoelectric elements is deformed. When the degree of deformation of the piezoelectric element changes, there is a change in the amount of pressure that is increased or decreased in the pressure chamber facing the piezoelectric element. When the amount of pressure that is increased or deceased in the pressure chamber changes, there is a change in the amount of ink discharged from the nozzle that communicates with the pressure chamber. When the amount of ink discharged from the nozzle changes, the amount of ink adhering to the print medium is unstable.

Moreover, the structural crosstalk phenomenon also occurs in the case where the aforementioned common piezoelectric sheet is not used. The structural cross-talk phenomenon may occur even in the case where the piezoelectric elements are formed from individual piezoelectric sheets. Specifically, when a common vibration plate is formed between the piezoelectric elements and the pressure chambers, the deformation of a certain vibration region corresponding to one piezoelectric element may affect the amount of deformation of a vibration region neighboring to the certain vibration region. This type of case may also be termed the structural cross-talk phenomenon

BRIEF SUMMARY OF THE INVENTION

The present inventors observed the problem that, when two adjacent piezoelectric elements are simultaneously deformed in the same direction, the structural cross-talk phenomenon causes the piezoelectric elements to deform by a smaller amount. When a term of 'structural cross-talk phenomenon' is referred to in the following description, this means the phenomenon where an amount of deformation of piezoelectric elements becomes a smaller amount by simultaneous deformation of two adjacent piezoelectric elements (or two adjacent element lines). When the present inventors performed detailed research on the structural cross-talk phenomenon, they found that the effects thereof were not particularly large when the structural cross-talk phenomenon occurred only between two adjacent piezoelectric elements.

The preset inventors discovered that when the piezoelectric elements of two adjacent element lines were deformed simultaneously, the structural cross-talk phenomenon occurred between the two adjacent element lines. They discovered that the structural cross-talk phenomenon between the two adjacent element lines exerted a strong influence on the amount of ink discharged from the nozzles. That is, when the structural cross-talk phenomenon occur between the two adjacent element lines, the piezoelectric elements deform by a smaller amount than when the structural cross-talk phenomenon occur only between two adjacent piezoelectric elements.

Using FIG. 20 as an example, if the piezoelectric elements of the element line X1 and the piezoelectric elements of the element line X2 we simultaneously deformed in the same direction, the structural cross-talk phenomenon occurs between the element line X1 and the element line X2. In this case, there is an extremely small amount of ink discharged from the nozzles of the nozzle line Y1 and the nozzle line Y2. In comparison, if only the piezoelectric elements of the element line X1 are simultaneously deformed in the same direction, a larger amount of ink is discharged from the nozzles of the nozzle line Y1. This is because, in this latter case, the structural cross-talk phenomenon is not occurring between the element line X1 and the element line X2. In the case where the structural cross-talk phenomenon is occurring between the two adjacent element lines, there is an extremely small amount of ink adhering to the print medium in comparison with the case where this is not occurring. When the structural cross-talk phenomenon is occurring between the two adjacent element lines, satisfactory printing cannot be achieved.

The present inventors discovered that satisfactory printing can generally be achieved if the structural cross-talk phenomenon is prevented from occurring between two adjacent element lines. If the structural crosstalk phenomenon occurs only between two adjacent piezoelectric elements, the effects thereof are small, and relatively satisfactory printing can be achieved.

The structural cross-talk phenomenon can be prevented from occurring between two adjacent element lines by providing a time difference between the timing at which one of two adjacent element lines is made to deform simultaneously, and the timing at which the other of the two adjacent element lines is made to deform simultaneously.

FIG. 21 shows an example of a case where the element lines have been set to have differing timing for deformation. The piezoelectric elements are deformed in sequence with the timing shown by the numbers. In the example in FIG. 21, when the nozzle line Y1 is facing the position where the straight line Z1 is to be printed, the piezoelectric elements in the element line X1 are simultaneously deformed with a timing 1. When the nozzle line Y2 is facing the position where the straight line Z1 is to be printed, the piezoelectric elements in the element line X1 are simultaneously deformed with the timing 1, and the piezoelectric elements in the element line X2 are deformed with a timing 2. Since the element line X1 and the element line X2 are deformed with different timings, the structural cross-talk phenomenon can be prevented from occurring between the element line X1 and the element line X2.

When the two adjacent element lines have been set to deform, with differing timings as described above, the structural cross-talk phenomenon can be prevented from occurring between these element lines, and consequently satisfactory printing can be achieved.

Further, the content of FIGS. 20 and 21 are examples, and the scope of the present invention is not restricted based on the content of these figures. The scope of the present invention is determined on the basis of the claims. The ink jet printer of the present invention can be represented as follows.

An ink jet printer of the present invention is provided with an ink jet head and a controller. The ink jet head prints on a print medium by discharging ink. The ink jet head comprises a plurality of units. Each unit comprises a nozzle for discharging ink, a pressure chamber communicating with the nozzle, and a piezoelectric element facing the pressure chamber. The piezoelectric elements form at least two element lines within a first predetermined plane. Each element line is formed by at least two piezoelectric elements aligned in a first direction. Each element line is aligned in a second direction which is different from the first direction. The controller controls the ink jet head to print on the print medium by changing voltage applied to each piezoelectric element of the ink jet head. The controller controls timings at which the controller changes voltage applied to each piezoelectric element by the element line. It is preferred that a timing at which the controller changes voltage applied to one of the two adjacent element lines is different from a timing at which the controller changes voltage applied to the other of the two adjacent element lines.

This ink jet printer is capable of preventing the occurrence of the structural cross-talk phenomenon between the two adjacent element lines. Satisfactory printing can therefore be achieved.

BRIEF DESCRIPTION OF THE DRAWINGS

In FIG. 3, pressure chambers and apertures are shown by solid lines.

In FIG. 4, nozzles are shown by solid lines.

FIG. 11 shows the relationship between the projective points, the ink chambers, the nozzle lines, and the delay times.

DETAILED DESCRIPTION OF THE INVENTION

Figure 21:
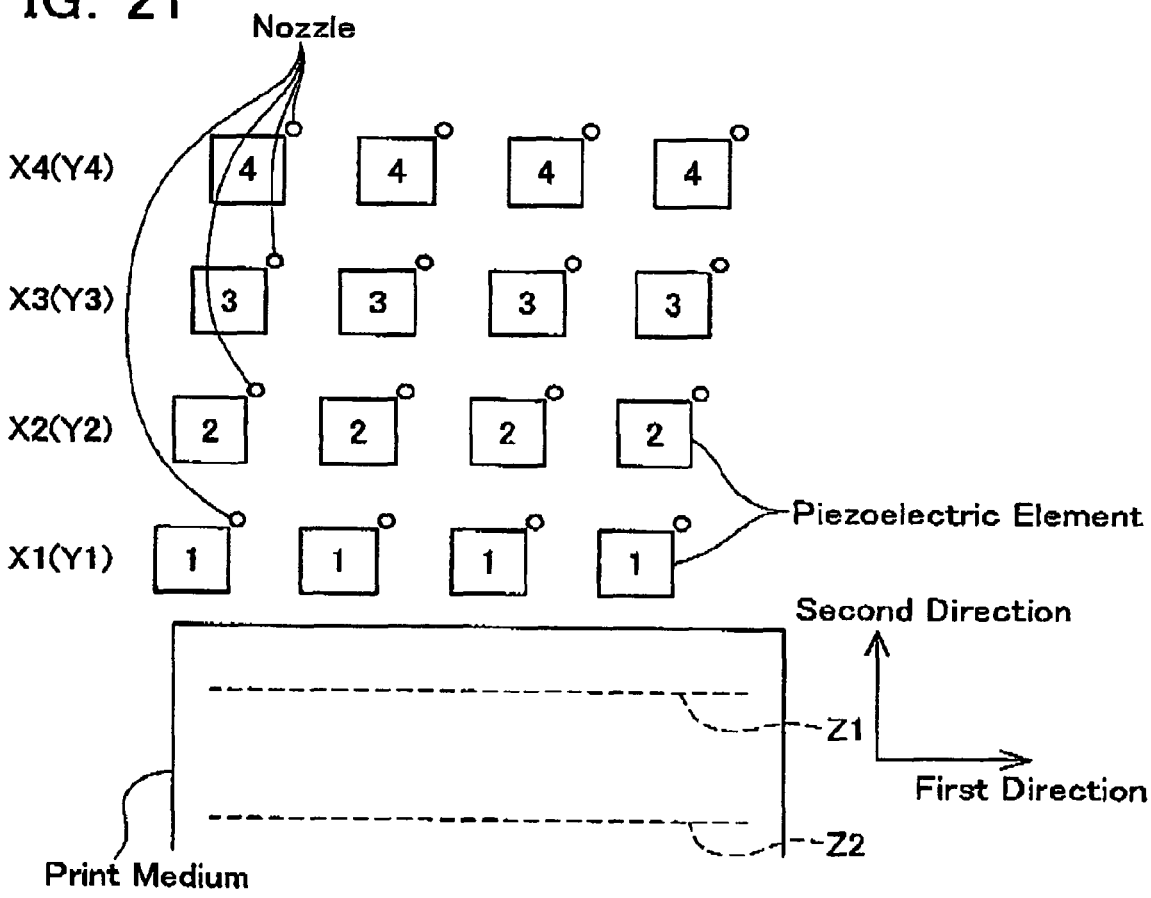
FIG. 21 shows timings at which the piezoelectric elements of the element lines arm deformed.
Figure 22:
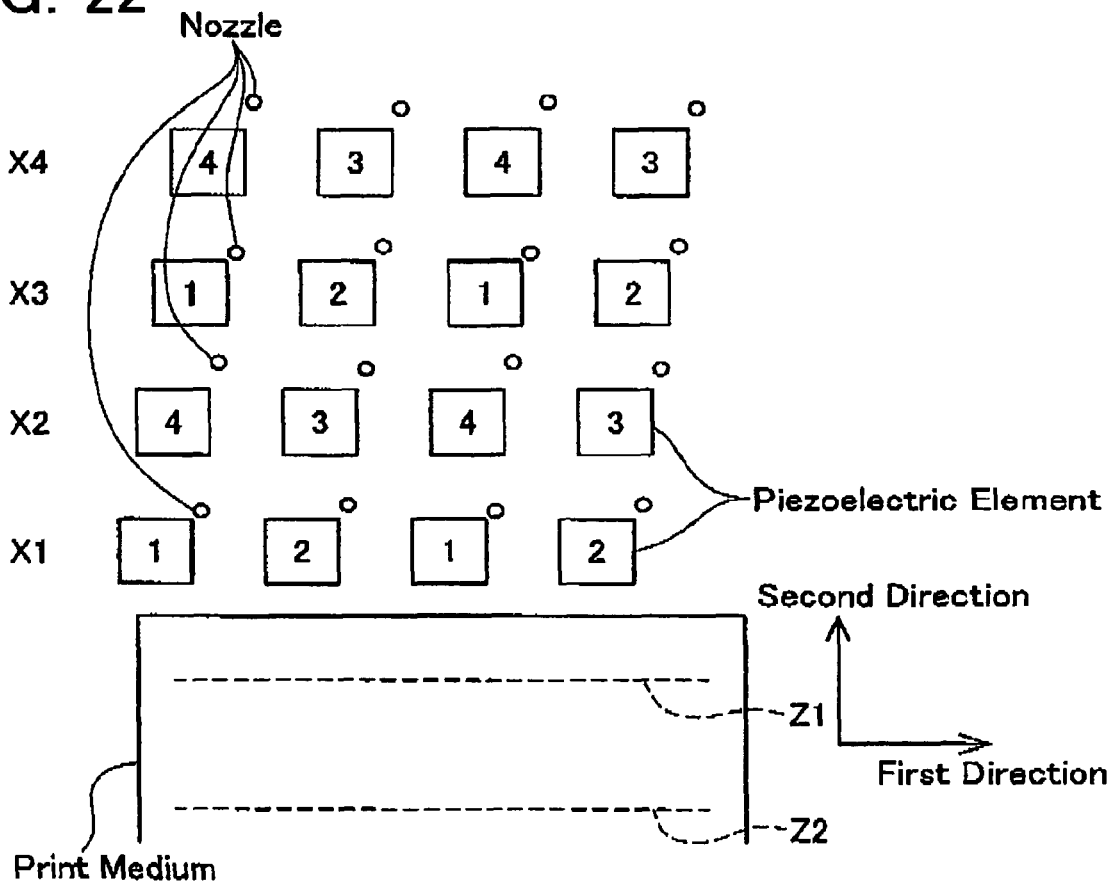
FIG. 22 shows timings at which the piezoelectric elements of the element lines are deformed.

FIG. 22 shows an example of timings at which the piezoelectric elements are deformed. Each piezoelectric element deforms in sequence with the timing shown by the numbers. For example, so that two adjacent piezoelectric elements are not deformed simultaneously, a timing 1 and a timing 2 are adopted alternately for the four piezoelectric elements of an element line X1. If this is done, it is possible to prevent the structural cross-talk phenomenon from occurring between two adjacent element lines and between two adjacent piezoelectric elements. If deformation is performed as in FIG. 22, the structural cross-talk phenomenon should be prevented from more effectively than if the timing of deformation is set by the element line, as described above in FIG. 21.

However, if the deformation timing is to be set by the piezoelectric element such that two adjacent piezoelectric elements do not deform simultaneously, this may make the arrangement of the nozzles more complicated. In the example shown in FIG. 22, two of the piezoelectric elements of the element line X1 deform with the timing 1, and the other two of the piezoelectric elements of the element line X1 deform with the timing 2. The print medium moves with respect to the ink jet head at a uniform speed in the second direction. Consequently, in order to form a straight line Z1 or a straight line Z2, the nozzles corresponding to the piezoelectric elements that deform with the timing 2 will be offset further in the second direction than the nozzles corresponding to the piezoelectric elements that deform with the timing 1. Similarly, the nozzles corresponding to the piezoelectric elements that deform with a timing 4 will be offset further in the second direction than the nozzles corresponding to the piezoelectric elements that deform with the time 3. In the example shown in FIG. 22, the four nozzles corresponding to the same element line are not aligned on a line extending in the first direction. The nozzles have a more complex arrangement than the arrangement in the example shown in FIG. 21. Further, if the example shown in FIG. 22 is used, the control required to discharge ink from each nozzle may become complicated.

The aim of the present invention is to prevent the structural cross-talk phenomenon from occurring between two adjacent element lines. If the present invention is used, the effect that the arrangement of the nozzles does not become more complicated, or the effect that the control for discharging ink does not become more complicated may also be realized as attendant effects. However, these effects need not necessarily be realized.

The controller may control the ink jet head as follows in order to print on the print medium. A timing at which the controller changes voltage applied to one of the two adjacent element lines from a first level to a second level is different from a timing at which the controller changes voltage applied to the other of the two adjacent element lines from the first level to the second level. Further, a timing at which the controller changes voltage applied to one of the two adjacent element lines from the second level to the first level is different from a dining at which the controller changes voltage applied to the other of the two adjacent element lines from the second level to the first level.

If this is done, the ink jet printer is capable of effectively preventing the occurrence of the structural cross-talk phenomenon between the two adjacent element lines.

In the aforementioned ink jet printer, it is preferred that a transferring device is further provided. The transferring device transfers the ink jet head and/or the print medium along a third direction in a state in which at least one nozzle of the ink jet head faces the print medium. The third direction may be perpendicular to the first direction in the first predetermined plane. The third direction may be the same direction as the second direction, or may be a different direction from the second direction.

As described above using the example of FIG. 22, this configuration allows the nozzles that correspond with the piezoelectric elements of the same element line to be disposed in the first direction. Consequently, the arrangement of the nozzles can be made simpler.

The nozzles of the ink jet head may form at least two nozzle lines in a second predetermined plane which is parallel to the first predetermined plane. In this case, each nozzle line may be formed by at least two nozzles aligned in the first direction. Each nozzle line may be aligned in the second direction. It is preferred that each nozzle is mutually offset in the first direction. The units comprising the piezoelectric elements that form the same element line may have the nozzles that form the same nozzle line.

In a case where the nozzles are projected from the third direction on a projective line extending in the first direction, it is preferred that the controller controls the ink jet head such that a timing at which one of the two adjacent nozzles on the projective line discharges ink is different from a timing at which the other of the two adjacent nozzles on the projective line discharges ink.

If this is done, the amount of ink discharged from one of two adjacent nozzles on the projective line will tend to differ from the amount of ink discharged from the other of the two adjacent nozzles. Nozzles that discharge a large amount of ink are not disposed in a continuous manner on the projective line, and nozzles that discharge a small amount of ink are not disposed in a continuous manner on the projective line. As a result, it is possible to prevent large dots from being formed continuously on the print medium, and it is possible to prevent small dots from being formed continuously on the print medium. In this technique, each dot which has different scale may be dispersed. As a result, satisfactory printing can be achieved. This point will be described in detail later.

The element lines may form a plurality of element line groups. Each element line group may be formed by at least two element lines continuously aligned in the second direction. In this case, the controller may control the ink jet head such that there is a mutual differing of the tins at which the controller changes voltage applied to each one of the element lines of the same element line group. For example, in the case where three element lines are present in one element line group, the timing for deforming the first element line, the timing for deforming the second element line, and the timing for deforming the third element line may mutually differ.

The ink jet head may comprise a plurality of ink chambers. Each ink chamber may correspond with a different element line group. It is preferred that the pressure chambers facing the piezoelectric elements included in the same element line group communicate with the ink chamber that corresponds with the element line group.

If this is done, all the pressure chambers which communicate with one ink chamber may not be simultaneously pressurized. As a result, the occurrence of the fluid cross-talk phenomenon can be prevented. The fluid cross-talk phenomenon is a phenomenon in which pressure waves generated in the pressure chambers that communicate with the same ink chambers overlap within the ink chamber and are amplified, thus affecting ink discharge performance.

In a case where each nozzle is projected from the third direction on a projective line extending in the first direction, it is preferred that the ink chamber with which one of the two adjacent nozzles on the projective line communicates is different from the ink chamber with which the other of the two adjacent nozzles on the projective line communicates.

The amount of ink discharged from two nozzles that communicate with the same ink chamber tends to be the same. Furthermore, the amount of ink discharged from two nozzles that communicate with differing ink chambers tends to differ. With the aforementioned configuration, two adjacent nozzles on the projective line tend to discharge differing amounts of ink because the two adjacent nozzles communicate with differing ink chambers. Consequently, with the aforementioned configuration, nozzles that discharge a large amount of ink are not disposed in a continuous manner on the projective line, and nozzles that discharge a small amount of ink are not disposed in a continuous manner on the projective line. As a result, it is possible to prevent large dots from being formed continuously on the print medium, and it is possible to prevent small dots from being formed continuously on the print medium. Each dot which has different scale may be dispersed. As a result, satisfactory printing can be achieved.

The piezoelectric elements may form at least three element lines. In this case, each element line may be separated from one another by equal spacing.

Further, each ink chamber may extend in the first direction and be aligned in the second direction. If this is done, the direction in which the ink chambers extend, the direction in which the element lines extend, the direction in which the nozzle lines extend, and the direction in which the pressure chamber lines extend may be made to conform. An ink jet head car be realized in which each element is disposed regularly.

Each piezoelectric element may have a substantially polygon shape in the first predetermined plane. In this case, it is preferred that an apex of one of the two adjacent piezoelectric elements forming the same element line, and an apex of the other of the two adjacent piezoelectric elements forming the same element line, face each other.

If this is done, it may be achieved that the structural cross-talk phenomenon will not occur between the two adjacent piezoelectric elements forming the same element line. This point will be described again later.

It is preferred that a time difference between the timing at which the controller changes voltage applied to one of the two adjacent element lines, and the timing at which the controller changes voltage applied to the other of the two adjacent element lines, is substantially equal to the shortest period for preventing the occurrence of the structural cross-talk phenomenon between the two adjacent element lines.

If this is done, it is possible to prevent a lengthening of the time required for printing. Rapid printing can be realized Each piezoelectric element may comprise a common piezoelectric sheet. Further, each piezoelectric element may individually have a piezoelectric sheet. In the latter case, the structural cross-talk phenomenon cannot readily occur. However, even though the structural cross-talk phenomenon cannot readily occur, the technique of the present invention may also be adopted for the latter configuration. In the latter case, a configuration may be adopted in which a common vibration plate is formed between the piezoelectric elements and the pressure chambers. In this case, the vibration plate may cause the occurrence of the structural cross-talk phenomenon. The technique of the present invention functions effectively for this configuration.

The controller may comprise a pulse output section and at least two delay sections. The pulse output section may output a pulse signal to each delay section. Each delay section may input the pulse signal output from the pulse output section. Each delay section may output a delayed pulse signal including delay time to the ink jet head. Each delay section may adopt a different delay time from the other.

If this configuration is adopted, the timing at which voltage applied to the piezoelectric elements forming one of the two adjacent element lines is simultaneously changed can differ from a timing at which voltage applied to the piezoelectric elements forming the other of the two adjacent element lines is simultaneously changed.

The following ink jet printer is also useful. This ink jet printer comprises an ink jet head and a controller. The ink jet head prints on a print medium by discharging ink, and comprises a plurality of units and an ink chamber. Each unit comprises a nozzle for discharging ink and a pressure chamber communicating with the nozzle. Each pressure chamber communicates with the ink chamber. The pressure chambers form at least two pressure chamber lines in a third predetermined plane, and each pressure chamber line is formed by at least two pressure chambers aligned in a forth direction. Each pressure chamber line is aligned in a fifth direction which is different from the forth direction. The controller controls the ink jet head to print on the print medium by changing pressure within each pressure chamber. The controller controls timings at which the controller changes pressure within each pressure chamber by the pressure chamber line. It is preferred that a timing at which the controller changes pressure within one of the two adjacent pressure chamber lines is different from a timing at which the controller changes pressure within the other of the two adjacent pressure chamber lines.

With this ink jet printer, the occurrence of the fluid cross-talk phenomenon can effectively be prevented.

This specification will teach a method of controlling an ink jet printer. This method comprises a controlling step of controlling an ink jet head to print on the print medium by changing voltage applied to each piezoelectric element of the ink jet head. The controlling step is performed such that tunings at which voltage applied to each piezoelectric element is changed are controlled by the element line. It is preferred that a timing at which voltage applied to one of the two adjacent element lines is changed is different from a timing at which voltage applied to the other of the two adjacent element lines is changed.

With this method, the structural cross-talk phenomenon can be prevented between the two adjacent element lines. Satisfactory printing can therefore be achieved.

This specification will teach a computer program product. This computer program product is executed by a computer device mounted on an ink jet printer. The computer program product includes instructions for ordering the computer device to perform a controlling step of controlling an ink jet head to print on the print medium by changing voltage applied to each piezoelectric element of the ink jet head. The controlling step is performed such that timings at which voltage applied to each piezoelectric element is changed are controlled by the element line. It is preferred that a timing at which voltage applied to one of the two adjacent element lines is changed is different from a timing at which voltage applied to the other of the two adjacent element lines is changed.

With this computer program product, the structural cross-talk phenomenon can effectively be prevented between the two adjacent element lines. Satisfactory printing can therefore be achieved.

First Embodiment

Figure 1:
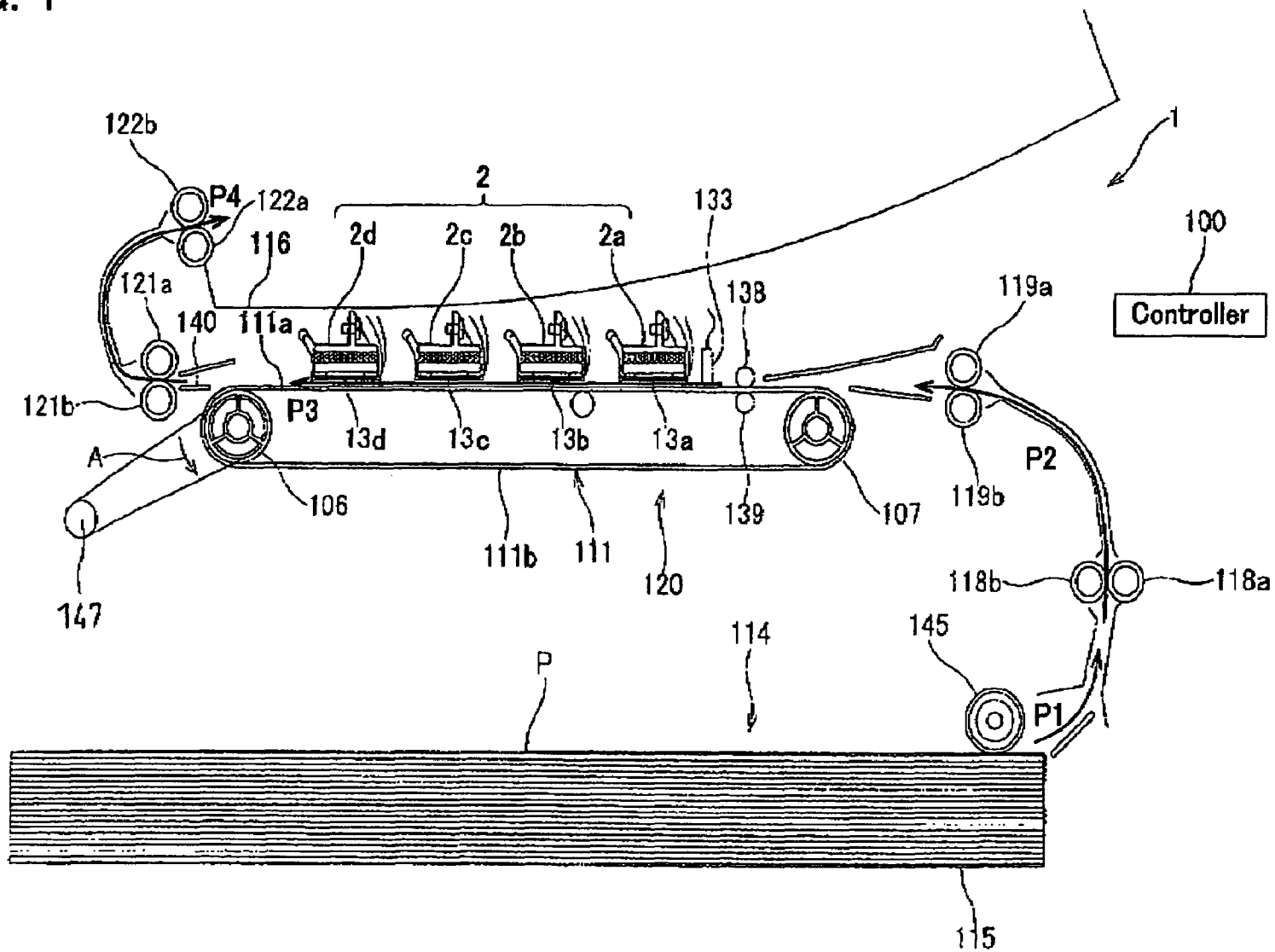
FIG. 1 shows a schematic view of an ink jet printer of a first embodiment.

An ink jet printer 1 of a first embodiment will be described with reference to the drawings. Below, the ink jet printer 1 may simply referred to as printer 1. FIG. 1 is a schematic view of the printer 1. The printer 1 has a feeding device 114. This feeding device 114 has a print paper housing section 115, a supply roller 145, a pair of rollers 118*a* and 118*b*, a pair of rollers 119*a* and 119*b*, etc. The print paper housing section 115 can house a plurality of sheets of print paper P in a stacked state. The print paper P has a rectangular shape extending in the left-right dion of FIG. 1. The supply roller 145 sends the uppermost sheet of print paper P in the print paper housing section 115 in the direction of the arrow P1. The print paper P that was sent in the direction of the arrow P1 is then transported in the direction of the arrow P2 by the pair of rollers 118*a* and 118*b* and the pair of rollers 119 and 119*b*.

The printer 1 has a conveying unit 120. The conveying unit 120 conveys the print paper P in the direction P3. The conveying unit 120 has a belt 111, belt rollers 106 and 107 etc. The belt 111 is wound across the belt rollers 106 and 107. The belt 111 is adjusted to have a length such that a predetermined tension is generated when it is wound across the belt rollers 106 and 107. The belt 111 has an upper face 111*a* that is located above the belt rollers 106 and 107, and a lower face 111*b* that is located below the belt rollers 106 and 107. The first belt roller 106 is connected to a conveying motor 147. The conveying motor 147 is caused to rotate by a controller 100. The other belt roller 107 rotates following the rotation of the belt roller 106. When the belt rollers 106 and 107 rotate, the print paper P mounted on the upper face 111*a* of the belt 111 is conveyed in the direction shown by the arrow P3.

A pair of nip rollers 138 and 139 is disposed near the belt roller 107. The upper nip roller 138 is disposed at an outer peripheral side of the belt 111. The lower nip roller 139 is disposed at an inner peripheral side of the belt 111. The belt 111 is gripped between the pair of nip rollers 138 and 139. The nip roller 138 is energized downwards by a spring (not shown). The nip roller 138 pushes the print paper P onto the upper face 111*a* of the belt 111. In the present embodiment, an outer peripheral face of the belt 111 comprises adhesive silicon gum. As a result, the print paper P adheres reliably to the upper face 111*a* of the belt 111.

A sensor 133 is disposed to the left of the nip roller 138. The sensor 133 is a light sensor comprising a light emitting element and a light receiving element. The sensor 133 detects a tip of the print paper P. Detection signals of the sensor 133 are output to the controller 100. The controller 100 can determine that the print paper P has reached a detecting position when the detection signals from the sensor 133 are input.

The printer 1 has a head unit 2. The head unit 2 is located above the conveying unit 120. The head unit 2 has four ink jet heads 2*a*, 2*b*, 2*c*, and 2*d*. The ink jet heads 2*a* to 2*d* are all fixed to a printer main body (not shown). That is, the printer 1 of the present embodiment is a line type printer. The ink jet heads 2*a* to 2*d* have ink discharging planes 13*a* to 13*d* respectively. The ink discharging planes 13*a* to 13*d* are formed at lower faces of the ink jet heads 2*a* to 2*d*. Ink is discharged downwards from the ink discharging planes 13*a* to 13*d* of the ink jet heads 2*a* to 2*d*. The ink jet heads 2*a* to 2*d* have an approximately rectangular parallelepiped shape that extends in a perpendicular direction relative to the plane of the page of FIG. 1. Magenta ink (M) is discharged from the ink jet head 2*a*. Yellow ink (Y) is discharged from the ink jet head 2*b*. Cyan ink (C) is discharged from the ink jet head 2*c*. Black ink (K) is discharged from the ink jet head 2*d*. In the present embodiment, four colors of ink can be used to perform color printing of the print paper P. The configuration of the ink jet heads 2*a* to 2*d* will be described in detail later. The operation of the ink jet heads 2*a* to 2*d* is controlled by the controller 100.

A space is formed between the ink discharging planes 13*a* to 13*d* and the upper face 111*a* of the belt 111. The print paper P is conveyed towards the left (in the direction of the row P3) along this space. Ink is discharged from the ink jet heads 2*a* to 2*d* onto the print paper P during this process of delivery in the direction of the arrow P3. The print paper P is thus printed with color words or images.

A plate 140 is supplied to the left of the conveying unit 120. When the print paper P is conveyed in the direction of the arrow P3, a right edge of the plate 140 enters between the print paper P and the belt 111, thus separating the print paper P from the belt 111.

A pair of rollers 121*a* and 121*b* is formed to the left of the plate 140. Further, a pair of rollers 122*a* and 122*b* is formed above the pair of rollers 121*a* and 121*b*. The print paper P, which has been conveyed in the direction of the arrow P3, is transported in the direction of an arrow P4 by the pair of rollers 121*a* and 121*b* and the pair of rollers 122*a* and 122*b*. A paper ejection section 116 is disposed to the right of the rollers 122*a* and 122*b*. The print paper P that has been transported in the direction of the arrow P4 is received in the paper ejection section 116. The paper ejection section 116 can maintain the print paper P in a stacked state Next, the configuration of the ink jet head 2*a* will be described. Since the other ink jet heads 2*b* to 2*d* have the same configuration as the ink jet head 2*a*, a detailed description thereof will be omitted.

Figure 2:
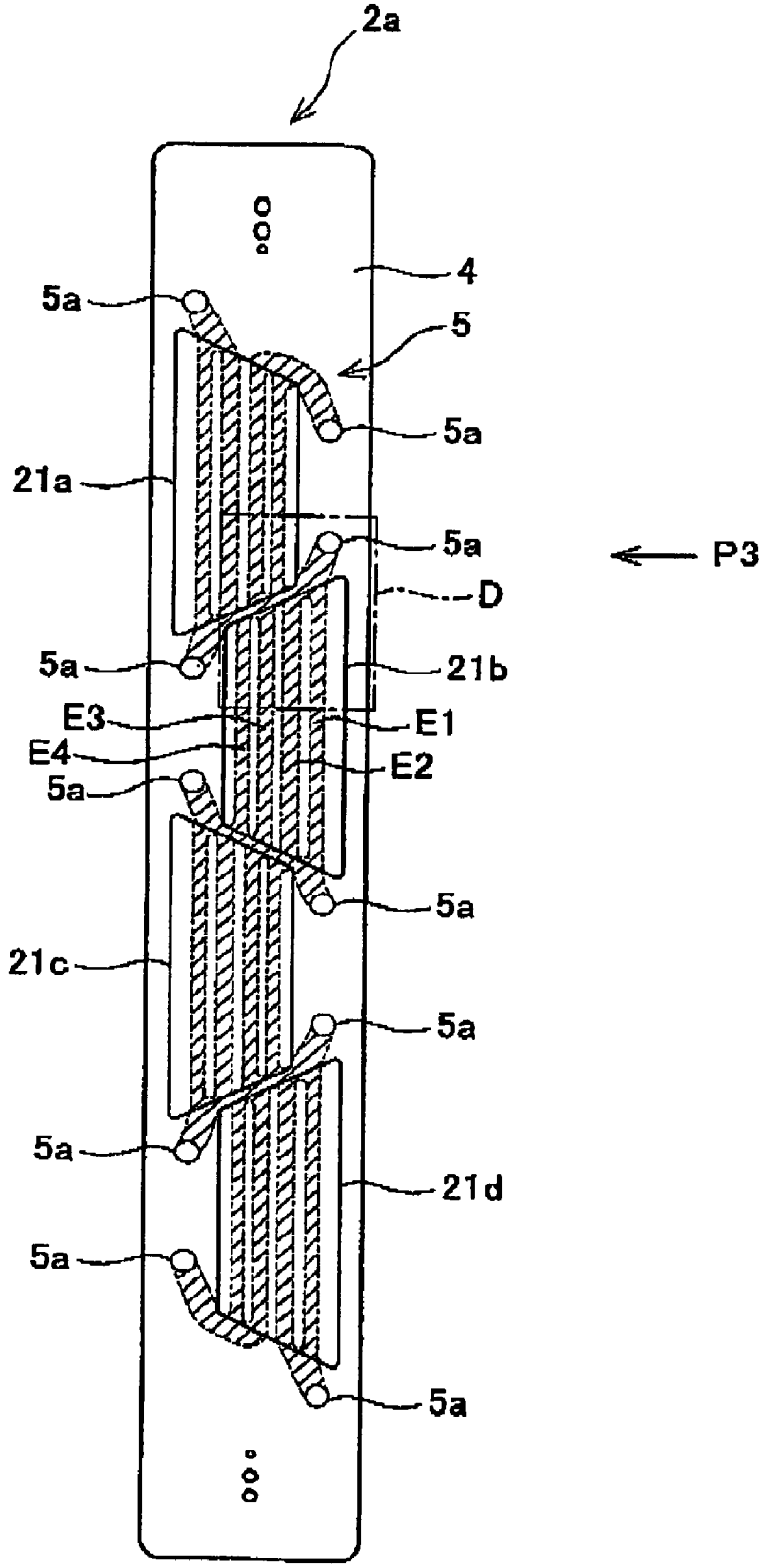
FIG. 2 shows a plan view of an ink jet head.

FIG. 2 shows a plan view of the ink jet head 2*a*. The ink jet head 2*a* has a passage unit 4 and four actuator units 21*a*, 21*b*, 21*c*, and 21*d*. Ink passages 5 are formed within the passage unit 4. In FIG. 2, main ink passages 5 within the passage unit 4 are shown by hatching. A plurality of openings 5*a* is fanned in an upper sure (a proximate side in the direction perpendicular to the plane of FIG. 2) of the passage unit 4. These openings 5*a* are connected to an ink tank (not shown). In the case of the ink jet head 2*a*, the openings 5*a* are connected to an ink tank that houses magenta ink. The ink in the ink tank is lead into the passage unit 4 via the openings 5*a*. The ink discharging plane 13*a* is formed at a lower surface (a far side in the direction perpendicular to the plane of FIG. 2) of the passage unit 4.

The ink passages 5 of the passage unit 4 have ink chambers E1 to E4. The ink chambers E1 to E4 are formed in a region that faces the actuator units 21*a* to 21*d*. In FIG. 2, reference numbers have been applied only to the ink chambers E1 to E4 facing the actuator unit 21*b*. Actually, however, four ink chambers are also formed in a region facing the actuator unit 21*a*. Four ink chambers are formed in regions facing the actuator units 21*c* and 21*d* respectively. The ink chambers E1 to E4 extend in the up-down direction of FIG. 2. The ink chambers E1 to E4 are aligned so as to be parallel. The ink chambers E1 to E4 are filled with ink that was led from the ink tank via the openings 5*a*.

The four actuator units 21*a* to 21*d* are fixed to the upper surface of the passage unit 4. The actuator units 21*a* to 21*d* each have a trapezoid shape when viewed from a plan view. The actuator units are aligned in the sequence 21*a*, 21*b*, 21*c*, and 21*d* from an upper side of FIG. 2. The actuator units 21*a* and 21*c* are disposed such that short sides thereof are at the right side and long sides thereof are at the left side. The actuator units 21*b* and 21*d* are disposed such that short sides thereof are at the left side and long sides thereof are at the right side. The actuator units 21*a* and 21*b* are disposed so as to overlap in the left-right direction of FIG. 2. Further, the actuator units 21*a* and 21*b* are disposed so as to overlap in the up-down direction of FIG. 2. Similarly, the actuator units 21*b* and 21*c* are disposed so as to overlap in the left-right direction and the up-down direction. The actuator units 21*c* and 21*d* are disposed so as to overlap in the left-right direction and the up-down direction.

An FPC (Flexible Printed Circuit; not shown) is connected to the actuator units 21*a* to 21*d*. The FPC delivers pulse signals (discharge signals) to the actuator units 21*a* to 21*d*. The actuator units 21*a* to 21*d* increase or reduce pressure of ink within pressure chambers 10 (to be described; see FIG. 3, etc.) of the passage unit 4 based on the discharge signals. Ink is thus discharged from the passage unit 4.

Below, the actuator units 21*a* to 21*d* may be represented as a group using the reference number 21.

Figure 3:
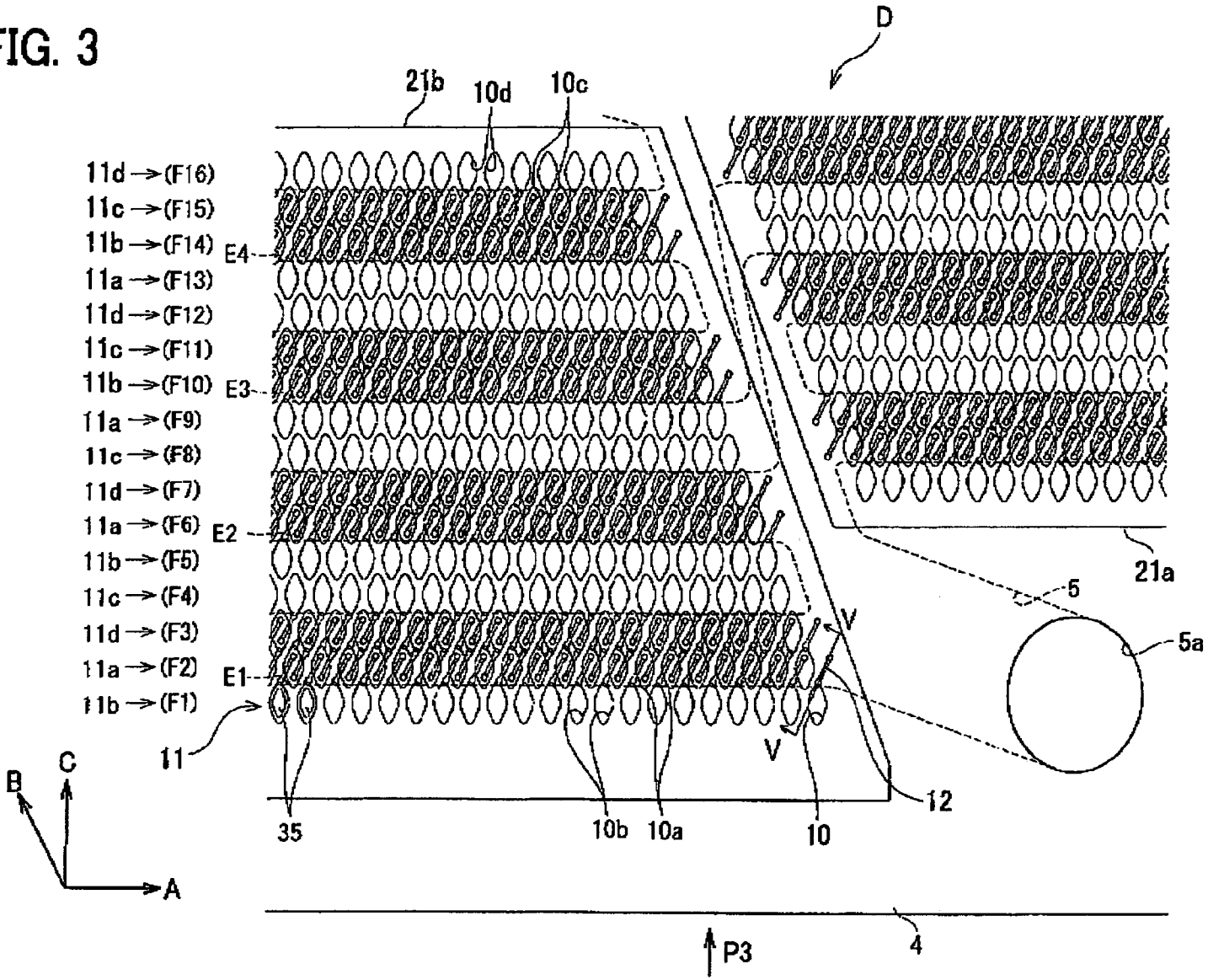
FIG. 3 shows all expanded view of a region D of FIG. 2.
Figure 4:
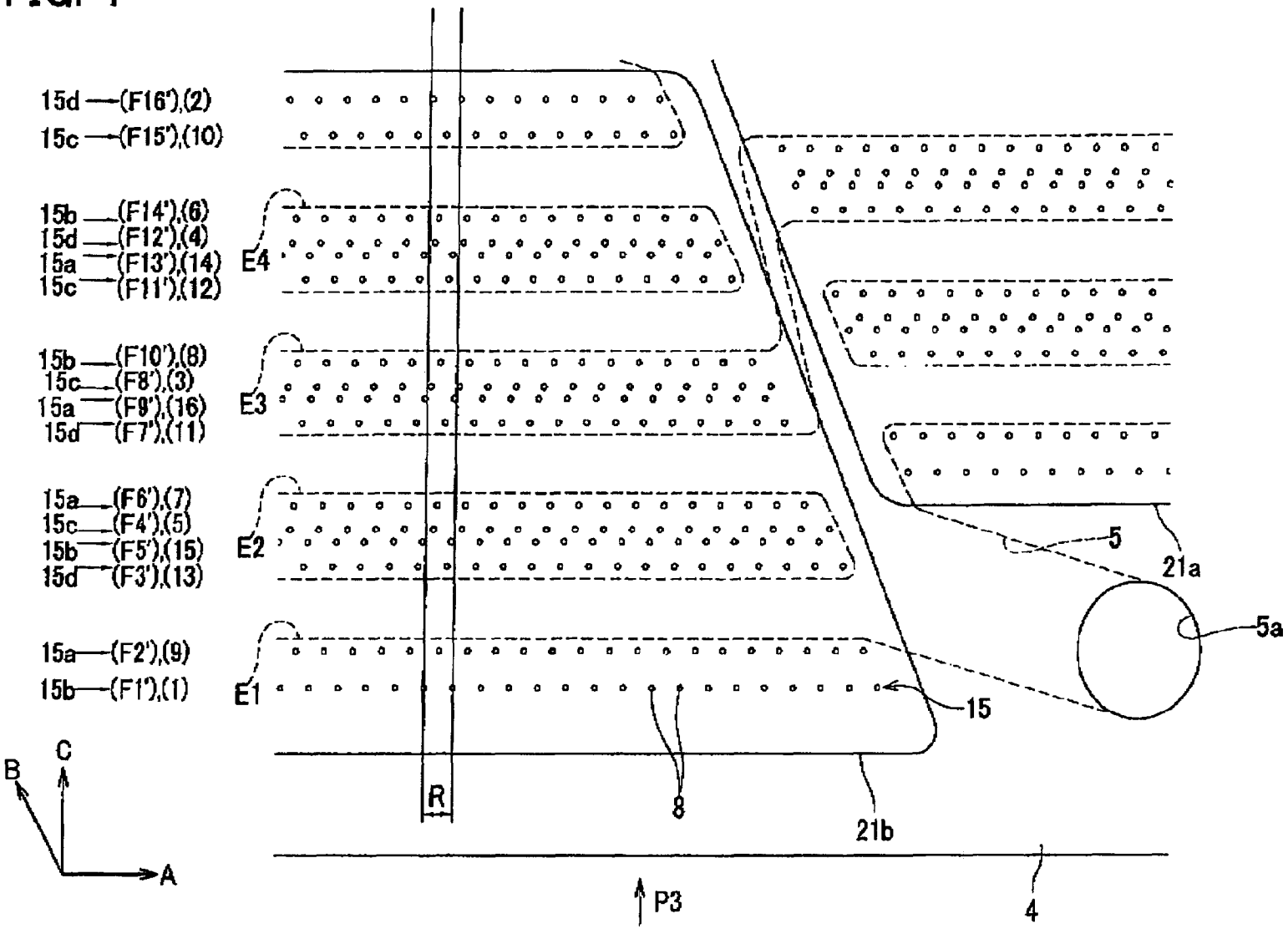
FIG. 4 shows an expanded view of the region D of FIG. 2.

FIGS. 3 and 4 are expanded plan views of a region D of FIG. 2. In FIG. 3, pressure chambers 10 and apertures 12 which actually cannot be seen in FIG. 3 are shown by solid lines. In FIG. 4, nozzles 8 which actually cannot be seen in FIG. 4 are shown by solid lines.

As shown in FIG. 3, a plurality of pressure chambers 10 and a plurality of apertures 12, etc. are formed within the passage unit 4. In FIG. 3, not all the pressure chambers 10 and apertures 12 are numbered. Further, only two individual electrodes 35 (to be described) are shown in FIG. 3. Actually, a plurality of individual electrodes 35 is formed so as to correspond to each of the pressure chambers 10. As shown in FIG. 4, a plurality of nozzles 8 is formed in the passage unit 4. In FIG. 4, not all the nozzles 8 are numbered.

Figure 5:
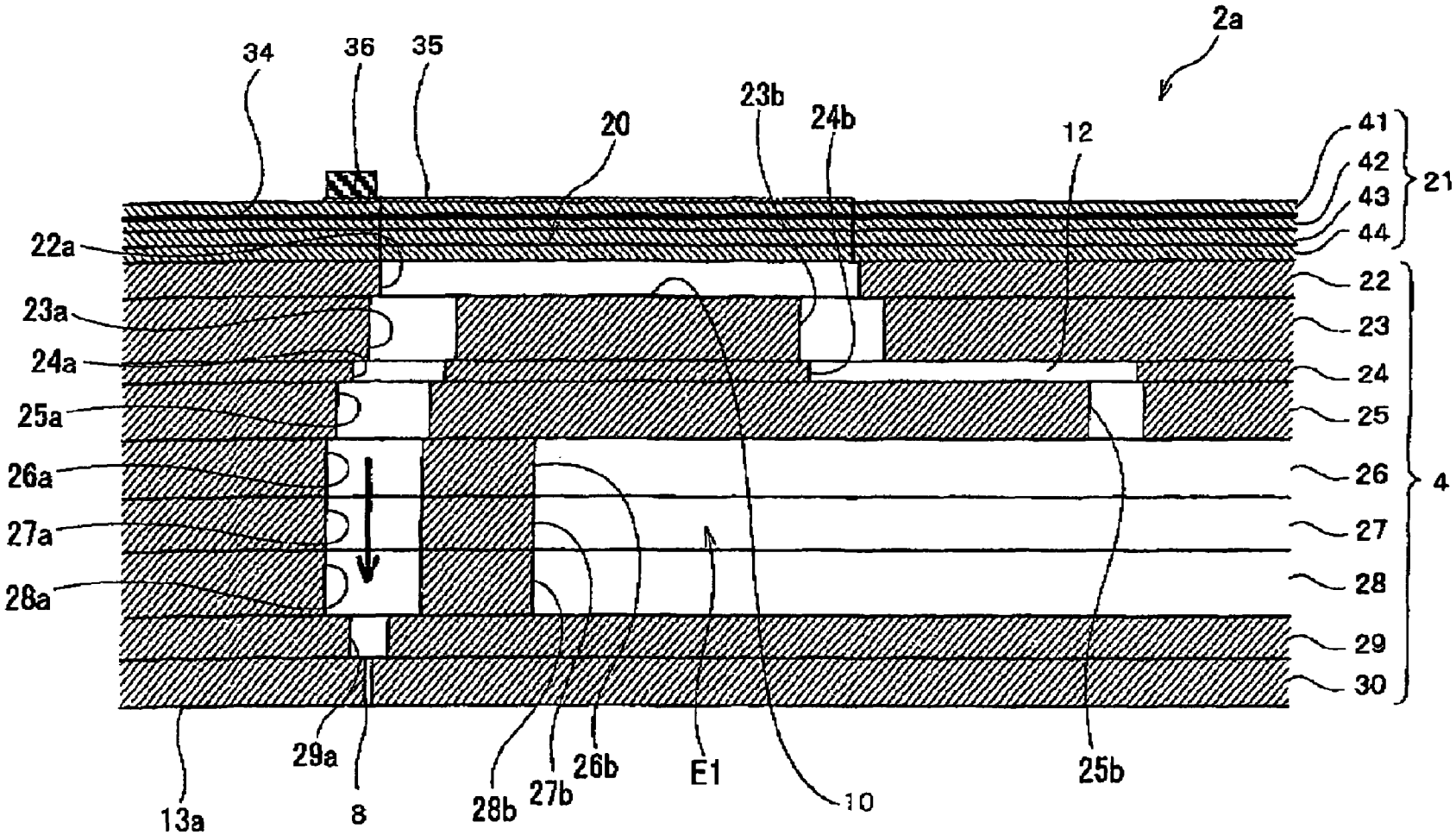
FIG. 5 shows a cross-sectional view along the line V-V of FIG. 3.

The configuration of the passage unit 4 and the actuator unit 21 will be described in detail with reference to FIG. 5. FIG. 5 is a cross-sectional view along the line V-V of FIG. 3.

The passage unit 4 is a structure in which nine metal plates 22 to 30 have been stacked. The nozzles 8 are formed in a nozzle plate 30, and pass through this nozzle plate 30. Only one nozzle 8 is shown in FIG. 5. However, a plurality of nozzles 8 is actually formed (see FIG. 4).

A cover plate 29 is stacked on an upper surface of the nozzle plate 30. A plurality of through holes 29*a* is formed in the cover plate 29. The through holes 29*a* are formed in positions corresponding to the nozzles 8 of the nozzle plate 30.

Three manifold plates 26, 27, and 28 are stacked on an upper surface of the cover plate 29. A plurality of through holes 26*a* is formed in the manifold plate 26. A plurality of through holes 27*a* is formed in the manifold plate 27, and a plurality of through holes 28*a* is formed in the manifold plate 28. The through holes 26*a*, 27*a*, and 28*a* are formed in positions corresponding to the through holes 29*a* of the cover plate 29. The manifold plates 26, 27, and 28 have long holes 26*b*, 27*b*, and 28*b* respectively. The long holes 26*b*, 27*b*, and 28*b* have the shape of the ink passages 5 shown in FIGS. 2 and 3. The long holes 26*b*, 27*b*, and 28*b* are each formed in the same position. Spaces formed by the long holes 26*b*, 27*b*, and 28*b* are the ink passages 5. In FIG. 5, the ink chamber E1, which is a part of the ink passage 5, is shown.

A supply plate 25 is stacked on an upper surface of the manifold plate 26. A plurality of through holes 25*a* is formed in the supply plate 25. The through holes 25*a* are formed in positions corresponding to the through holes 26*a* of the manifold plate 26. Further, a plurality of through holes 25*b* is formed in the supply plate 25. The through holes 25*b* are formed in positions corresponding to the long holes 26*b* of the manifold plate 26.

An aperture plate 24 is stacked on an upper surface of the supply plate 25. A plurality of through holes 24*a* is formed in the aperture plate 24. The through holes 24*a* are formed in positions corresponding to the through holes 25*a* of the supply plate 25. Further, a plurality of long holes 24*b* is formed in the aperture plate 24. Right edges of the long holes 24*b* are formed in positions corresponding to the through holes 25*b* of the supply plate 25. Each long hole 24*b* functions as the aperture 12.

A base plate 23 is stacked on an upper surface of the aperture plate 24. A plurality of through holes 23*a* is formed in the base plate 23. The trough holes 23*a* are formed in positions corresponding to the through holes 24*a* of the aperture plate 24. Further, a plurality of trough holes 23*b* is formed in the base plate 23. The through holes 23*b* are formed in positions corresponding to left edges of the long holes 24*b* of the aperture plate 24.

A cavity plate 22 is stacked on an upper surface of the base plate 23. A plurality of long holes 22*a* is formed in the cavity plate 22. Left edges of the long holes 22*a* are formed in positions corresponding to the through holes 23*a* of the base plate 23. Right edges of the long holes 22*a* are formed in positions corresponding to the through holes 23*b* of the base plate 23. Each long hole 22*a* functions as the pressure clamber 10. The pressure chamber 10 communicates with the ink chamber E1 via the through hole 23*b*, the aperture 12, and the through hole 25*b*. Further, the pressure chamber 10 communicates with the nozzle 8 via the through hole 23*a*, the through hole 24*a*, the through hole 25*a*, the through hole 26*a*, the through hole 27*a*, the through hole 28*a*, and the through hole 29*a*.

As shown in FIG. 3, each pressure chamber 10 is approximately diamond shaped when viewed from a plan view. The plurality of pressure chambers 10 is disposed in a staggered pattern. Each of the pressure chambers 10 is aligned in an A direction and a B direction. The A direction is a direction orthogonal to the direction of the arrow P3 with respect to a plan view of the ink jet head 2*a* (within the plane of FIG. 3). Short diagonal edges of the pressure chambers 10 extend in the A direction. Long diagonal edges of the pressure chambers 10 extend in a C direction. The C direction is perpendicular to the A direction. An obtuse angle θ is formed between the A direction and the B direction. The B direction is a direction in which a pair of parallel sides of the pressure chambers 10 extends.

Two pressure chambers 10 that are adjacent in the A direction are separated by a distance corresponding to 37.5 dpi. A plurality of the pressure chambers 10 is aligned in the A direction. Sixteen pressure chambers 10 are aligned in the B direction. In the present embodiment, the pressure chambers aligned in the A direction are termed a pressure chamber line 11. Sixteen pressure chamber lines 11 are formed in a region corresponding to one actuator unit 21. Each pressure chamber line 11 could be said to be aligned in the direction of the arrow C.

The pressure chamber lines 11 are shown as F1 to F16 in sequence from the bottom to the top of FIG. 3. The pressure chamber lines F1 to F4 communicate with the ink chamber E1. The pressure chamber lines F5 to F8 communicate with the ink chamber E2. The pressure chamber lines F9 to F12 communicate with the ink chamber E3, and the pressure chamber lines F13 to F16 communicate with the ink chamber E4. Although this will be described in detail later, the timings at which pressure of ink within each one of the four pressure chamber lines (for example, F1 to F4) that communicate with the same ink chamber (for example, E1) is increased or reduced mutually differ. Pressure of ink within the pressure chamber lines F1, F5, F10, and F14 is increased or reduced with the same timing. Pressure of ink within the pressure chamber lines F2, F6, F9, and F13 is increased or reduced with the same timing. Pressure of ink within the pressure chamber lines F3, F7, F12, and F16 is increased or reduced with the same timing. Pressure of ink within the pressure chamber lines F4, F8, F11, and F15 is increased or reduced with the same timing. Below, the pressure chamber lines F1, F5, F10, and F14 that increase or reduce pressure with the same timing are termed a pressure chamber line 11*b*. The pressure chamber lines F2, F6, F9, and F13 are termed a pressure chamber line 11*a*. The pressure chamber lines F3, F7, F12, and F16 are termed a pressure chamber line 11*d*, and the pressure chamber lines F4, F8, F11, and F15 are termed a pressure chamber line 11*c*.

In the plan view of FIG. 3, the major part of the pressure chambers 10 of the pressure chamber lines F2, F3, F6, F7, F10, F11, F14, and F15 overlaps with the ink chambers E1 to E4. However, the pressure chambers 10 of the pressure chamber lines F1, F4, F5, F8, F9, F12, F13, and F16 barely overlap with the ink chambers E1 to E4.

The nozzles 8 communicating with pressure chambers 10*a* that comprise the pressure chamber lines 11*a* (F2, F6, F9, F13) are present at a position facing a lower edge part of the pressure chambers 10*a*. Similarly, nozzles 8 communicating with pressure chambers 10*b* that comprise the pressure chamber lines 11*b* (F1, F5, F10, F14) are present at a position facing a lower edge part of the pressure chambers 10*b*. By contrast nozzles 8 communicating with pressure chambers 10*c* that comprise the pressure chamber lines 11*c* (F4, F8, F11, F15) are present at a position facing an upper edge part of pressure chambers 10*c*. Similarly, nozzles 8 communicating with pressure chambers 10*d* that comprise the pressure chamber lines 11*d* (F3, F7, F12, F16) are present at a position facing an upper edge part of pressure chambers 10*d*. As shown in FIG. 4, when the ink jet head 2 is viewed from a plan view, all the nozzles 8 don't overlap with the ink chambers E1 to E4. Adjacent two nozzles 8 in the A direction are separated by a distance corresponding to 37.5 dpi.

As shown in FIG. 4, the plurality of nozzles aligned in the A direction forms a nozzle line 15. In the present embodiment, sixteen nozzle lines 15 are aligned in the direction of the arrow C. The sixteen nozzle lines 15 are termed nozzle lines F1' to F16' respectively. The nozzle line F1' is formed from the nozzles 8 communicating with the pressure chambers 10 of the pressure chamber line F1. Similarly, the nozzle line Fn' (n=1 to 16) are formed from the nozzles 8 communicating with the pressure chambers 10 of the pressure chamber line Fn.

As is clear from FIG. 4, the sequence in which the nozzle lines F4' and F5' are disposed is the inverse of the sequence in which the pressure chamber lines F4 and F5 are disposed. The sequence in which the nozzle lines F8' and F9' are disposed is the inverse of the sequence in which the pressure chamber lines F8 and F9 are disposed. The sequence in which the nozzle lines F12' and F13' are disposed is the inverse of the sequence in which the pressure chamber lines F12 and F13 are disposed.

Further, in FIG. 4, nozzle lines F2', F6', F9', and F13' that communicate with the pressure chamber lines 11*a* are represented by the reference number 15*a*. Similarly, nozzle lines F1', F5', F10', and F14' that communicate with the pressure chamber lines 11*b* are represented by the number 15*b*, nozzle lines F4', F8', F11', and F15' that communicate with the pressure chamber lines 11*c* are represented by the number 15*c*, and nozzle lines F3', F7', F12', and F16' that communicate with the pressure chamber lines 11*d* are represented by the number 15*d*.

The nozzles 8 are offset in the A direction. That is, more than two nozzles 8 are not present in the same position in the A direction. In FIG. 4, a region P, is shown. The region R has a width (678.0 μm) in the longitudinal direction (the left-right direction of FIG. 4) of the passage unit 4. Sixteen nozzles 8 are present within the region R. There is one nozzle 8 out of each nozzle line F1' to F16' within the region R. Each of these nozzles 8 is offset in the A direction, and is disposed at equal spacing in the A direction. This spacing is a distance corresponding to 600 dpi. This 600 dpi is the resolution for printing.

In the sixteen nozzles 8 included in the region R, the leftmost nozzle 8 is included in the nozzle line F1'. The nozzle 8 which is the second from the left is included in the nozzle line F16'. The nozzle 8 which is the third from the left is included in the nozzle line F8'. The aforementioned sequence is represented by numbers in FIG. 4. That is, (1) corresponds to the nozzle line F1', (16) corresponds to the nozzle line F16', and (3) corresponds to the nozzle line F8'. The remaining nozzle lines F2' etc. are similarly represented in sequence. That is, the nozzles 8 that constitute the nozzle lines F2' etc. are represented by the numbers signifying their position from the left within the region R.

The above sequence (1) to (16) can be expressed in other words in the following manner. The sequence (1) to (16) can be expressed as a sequence from the left of positions of projective points in the case where the sixteen nozzles 8 in the region R has been projected from the C direction on a virtual line (projective line) extending in the A direction. If the regions R have been partitioned as units along the left-right direction of the passage unit 4, the arrangement of the nozzles 8 in these regions R accords with the sequence of the projective points shown in FIG. 4.

Returning to FIG. 5, the configuration of the actuator unit 21 will be described. The actuator unit 21 is connected to an upper surface of the cavity plate 22. Actually, the four actuator units 21*a* to 21*d* are connected to the cavity plate 22.

The actuator unit 21 comprises four piezoelectric sheets 41, 42, 43, and 44, a common electrode 34, the individual electrodes 35, etc. The thickness of each of the piezoelectric sheets 41 to 44 is approximately 15 μm. The thickness of the actuator unit 21 is approximately 60 μm. Each of the piezoelectric sheets 41 to 44 has approximately the same area as the single actuator unit 21. That is, each piezoelectric sheet 41 to 44 has a trapezoid shape when viewed from a plan view. The piezoelectric sheets 41 to 44 extend across the plurality of pressure chambers 10. The piezoelectric sheets 41 to 44 are formed from zirconate titanate (PZT) ceramic material which has a ferroelectricity.

The common electrode 34 is disposed between the uppermost piezoelectric sheet 41 and the piezoelectric sheet 42 formed below the piezoelectric sheet 41. The common electrode 34 has approximately the same area as the piezoelectric sheet 41 to 44, and has a trapezoid shape when viewed from a plan view. The common electrode 34 has a thickness of approximately 2 μm. The common electrode 34 is made from a metal material such as, for example, Ag—Pd. Electrodes are not disposed between the piezoelectric sheet 42 and the piezoelectric sheet 43, between the piezoelectric sheet 43 and the piezoelectric sheet 44, or between the piezoelectric sheet 44 and the cavity plate 22. The common electrode 34 is connected with a ground (not shown).

A plurality of the individual electrodes 35 that has a thickness of 1 μm is disposed on an upper surface of the uppermost piezoelectric sheet 41. Each individual electrode 35 is disposed in a position corresponding to one of each of the pressure chambers 10. The individual electrodes 35 are made from a metal material such as, for example, Ag—Pd. A land 36 having a thickness of approximately 15 μm is formed at one end of each individual electrode 35. Each individual electrode 35 and each land 36 are joined conductively. The lands 36 may be composed of, for example, metal that contains glass flit. The lands 36 are electrically connected with the FPC (not shown). The individual electrodes 35 are electrically connected with a driver IC of the controller 100 via wiring of the FPC. The controller 100 can thus individually control the voltage of each of the individual electrodes 35.

Figure 6:
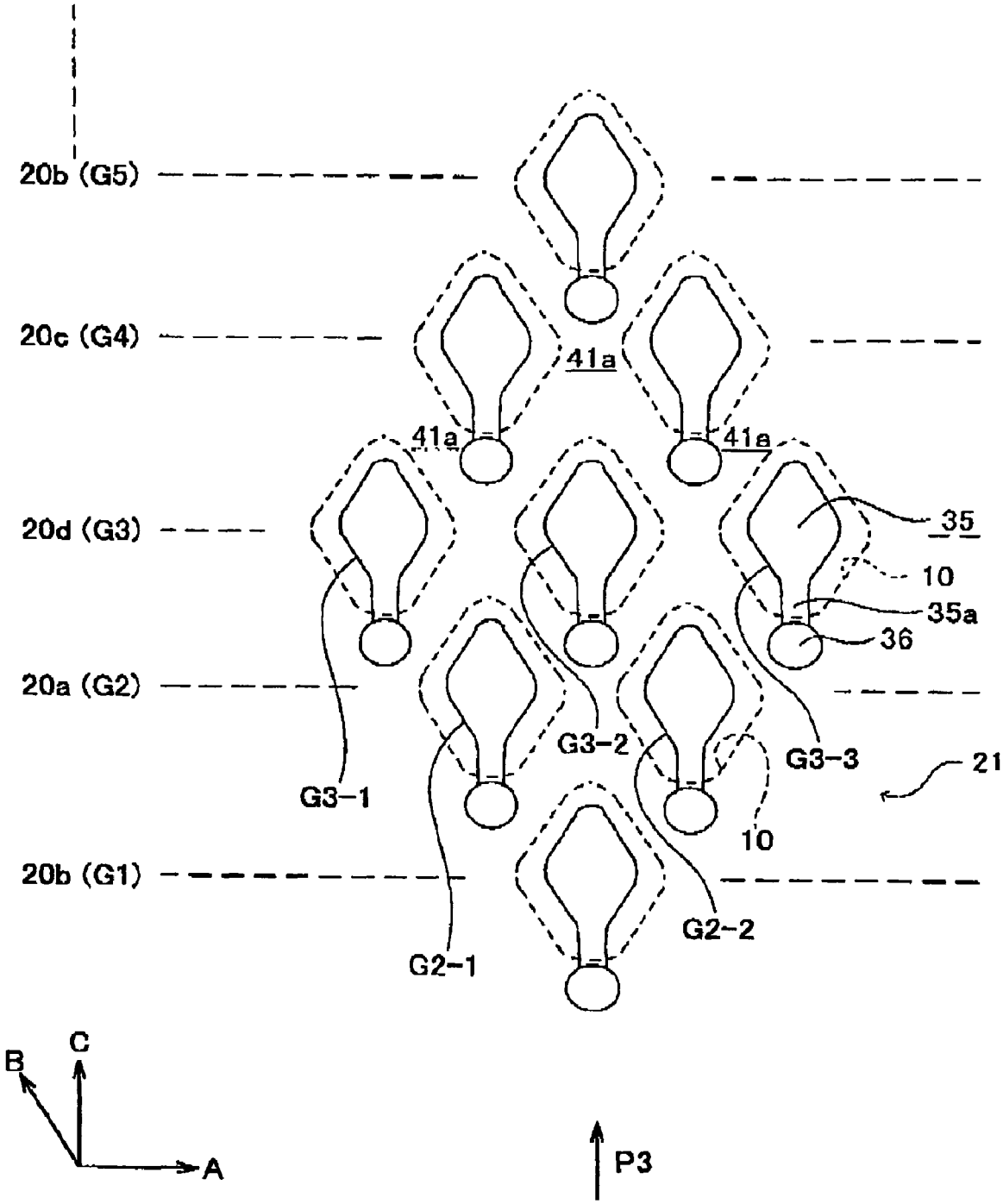
FIG. 6 shows an expanded plan view of a portion of an actuator unit.

FIG. 6 shows an expanded plan view of a portion of the actuator unit 21. As shown in FIG. 6, the individual electrodes 35 are approximately diamond shaped when viewed from a plan view. One individual electrode 35 faces one pressure chamber 10. Each individual electrode 35 is smaller than the pressure chamber 10. The major part of each individual electrode 35 overlaps with the pressure chamber 10. A protruding part 35*a* is formed on each individual electrode 35. This protruding part 35*a* extends downwards from an acute angle of a lower side of the diamond shape. The protruding part 35*a* extends into regions 41*a* in which the pressure chambers 10 are not formed. The lands 36 are formed in these regions 41*a*.

Since one individual electrode 35 faces one pressure chamber 10, the individual electrodes 35 are disposed with the same pattern as the pattern with which the pressure chambers 10 are disposed. That is, the plurality of individual electrodes 35 form electrode lines that are aligned in the A direction. Sixteen electrode lines are formed in one actuator unit 21. The electrode lines are aligned in the C direction.

In the present embodiment, the individual electrodes 35 are formed only on the surface of the actuator unit 21. As will be described in detail later, only the piezoelectric sheet 41 between the common electrode 34 and the individual electrodes 35 forms an activated part of the piezoelectric sheets. With this type of configuration, the unimorph deformation in the actuator unit 21 has superior efficiency.

When a voltage difference is applied between the common electrode 34 and the individual electrodes 35, a region of the piezoelectric sheet 41 to which the electric field is applied deforms due to piezoelectric effects. This part functions as an active part. The piezoelectric sheet 41 can expand and contract in its direction of thickness (the stacking direction of the actuator unit 21). The other piezoelectric sheets 42 to 44 are non-active layers that are not located between the individual electrodes 35 and the common electrode 34. Consequently, they cannot deform spontaneously even when a voltage difference is applied between the individual electrodes 35 and the common electrode 34. In the actuator unit 21, the upper piezoelectric sheet 41 that is farther from the pressure chambers 10 is the active part, and the lower piezoelectric sheets 42 to 44 that are closer to the pressure chambers 10 are non-active parts. This type of actuator unit 21 is termed a unimorph type.

When a voltage difference is applied between the common electrode 34 and the individual electrodes 35 such that the direction of the electric field and the direction of polarization have the same direction, the active part of the piezoelectric sheet 41 contracts in a planar direction. By contrast, the piezoelectric sheets 42 to 44 do not contract in the planar direction. There is thus a difference in the rate of contraction of the piezoelectric sheet 41 and the piezoelectric sheets 42 to 44. As a result, the piezoelectric sheets 41 to 44 (including the common electrode 34) protrude towards the pressure chamber 10. The pressure in the pressure chambers 10 is thus increased. By contrast, when there is zero voltage difference between the common electrode 34 and the individual electrodes 35, the state in which the piezoelectric sheets 41 to 44 protrude towards the pressure chamber 10 is released. The pressure in the pressure chambers 10 is thus decreased.

The voltage of the individual electrodes 35 is controlled individually. There is deformation of the parts of the piezoelectric sheets 41 to 44 facing the individual electrodes 35 in which the voltage has been changed. One piezoelectric element 20 (see FIG. 5) is formed from one individual electrode 35 and the region facing that individual electrode 35 (the piezoelectric sheets 41 to 44 and the common electrode 34). Only one piezoelectric element 20 has been shown in FIG. 5. However, here are the same number of piezoelectric elements 20 as the number of individual electrodes 35 (the same number as the number of pressure chambers 10). The piezoelectric elements 20 are disposed with the same pattern as the pattern with which the individual electrodes 35 are disposed. That is, the piezoelectric elements 20 flat are aligned in the A direction form element lines G1 etc. (see FIG. 6). Only the element lines G1 to G5 are shown in FIG. 6. However, sixteen element lines G1 to G16 are present in one actuator unit 21. The element lines G1 to G16 are aligned in the C direction. The element line G1 is formed from the piezoelectric elements 20 facing the pressure chambers 10 of the pressure chamber line F1. Similarly, the element line Gn (n=1 to 16) is formed from the piezoelectric elements 20 facing the pressure chambers 10 of the pressure chamber line Fn. Each element line G1 to G16 is separated from one another by an equal spacing.

As described above, the pressure chamber lines with a particular letter of the alphabet (for example, 11*a*) correspond to the nozzle lines (for example, 15*a*) with the same letter (in this case, 'a'. The element lines G1 to G16 are represented in the same manner. For example, the piezoelectric elements 20 for the element line G1 are disposed facing the pressure chambers 10 forming the pressure chamber line 11*b*. Consequently, the element line G1 is represented as the element line 20*b* using the same letter 'b' as the pressure chamber line 11*b*. The remaining element lines G2 to G16 are represented as element lines 20*a* to 20*d* using the same letters as the corresponding pressure chambers lines 11*a* to 11*d*. In FIG. 6, the reference numbers 20*a* to 20*d* are shown.

The operation of the ink jet head 2 will be described with reference to FIG. 5. When printing is not being performed, a voltage higher than the voltage of the common electrode 34 is maintained in the individual electrodes 35 (this is termed high voltage). In this state, the piezoelectric elements 20 protrude towards the pressure chamber 10. Then, corresponding to the content to be printed, a selected individual electrode 35 is made to have the same voltage as the common electrode 34 (this is termed low voltage) at a predetermined timing. The piezoelectric element 20 thus deforms upwards, and the pressure in the pressure chamber 10 is decreased. In this state, the piezoelectric element 20 is in the state shown in FIG. 5. When the pressure in the pressure chamber 10 decreases, the ink in the ink chamber E1 is lead into the pressure chamber 10 via the through hole 25*b*, the aperture 12, and the through hole 23*b*. The pressure chamber 10 is thus filled with ink.

Next, the selected individual electrode 35 is caused to have high voltage. The piezoelectric element 20 deforms downwards, and the pressure in the pressure chamber 10 increases. The ink in the pressure chamber 10 is thus pressurized. The pressurized ink is discharged from the nozzle 8 via the through holes 23*a*, 24*a*, 25*a*, 26*a*, 27*a*, 28*a*, and 29*a*.

As described above, in order to discharge ink from the nozzles 8, the individual electrodes 35 are changed from high voltage to low voltage (this is termed a first change), and are then changed from low voltage to high voltage (this is termed a second change). Pulse signals in which the high voltage is the standard are supplied to the individual electrodes 35 in order to realize the first changes and second changes. It is preferred that the time between the first change and the second change in the pulse signals (that is, the pulse width) is set to the time AL (acoustic length) taken for a pressure wave to be disseminated from the ink chambers E1 to E4 to the nozzles 8. If this is done, ink droplets can be discharged from the nozzles 8 with a stronger pressure.

In the present embodiment, the density of dots on the print paper P can be adjusted by controlling the number of ink droplets discharged continuously from the nozzles 8. That is, gradual adjustment is executed by adjusting the number of ink droplets (i.e. the amount of ink for one dot). For example, if one dot is formed on the print paper P by continuously discharging three droplets of ink, the aforementioned first change and second change are repeated three times. In this case, it is preferred that the time between the second change and the first change is set to the aforementioned AL. A period of a residual pressure wave conforms a period of a pressure wave which occurs when the next ink droplet is discharged. Since the two pressure waves overlap, the pressure for discharging the next ink droplet can be made stronger.

Next, the configuration of the controller 100 for controlling the actuator unit 21 will be described. The controller 100 prints on the print paper P by causing ink to be discharged from the nozzles 8 while moving the print paper P in the direction of the arrow P3.

Figure 7:
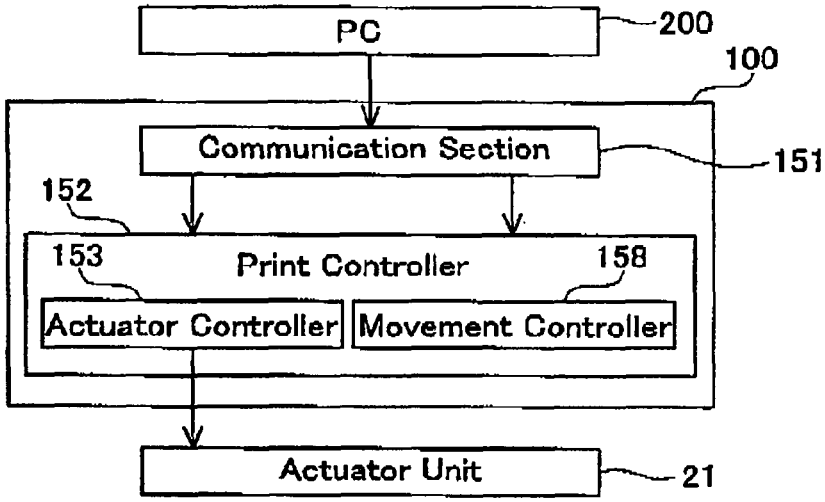
FIG. 7 is a block view showing the functions of a controller.

FIG. 7 is a block view showing the functions of the controller 100. The controller 100 comprises a CPU (Central Processing Unit), a ROM (Read Only Memory), a RAM (Random Access Memory), the driver IC, etc. Each section in FIG. 7 is constructed by performing these elements. The CPU executes programs stored in the ROM. The ROM stores programs to be executed by the CPU, and stores data used in the execution of these programs. The RAM temporarily stores data. The driver IC drives the actuator unit 21.

The printer 1 of the present embodiment is connected with an external device such as a PC 200, or the like. Data output from the PC 200 is taken into the controller 100. The controller 100 has a communication section 151 and a print controller 152, etc. The communication section 151 inputs commands (such as, for example, print data) output from the PC 200. The communication section 151 analyzes the commands that have been input, and outputs the analyzed information to the print controller 152. The print controller 152 inputs the information (for example, print data) output from the communication section 151, and controls a printing operation of the printer 1 based on the information that was input. The print controller 152 has an actuator controller 153 and a movement controller 158. The actuator controller 153 controls the operation of the actuator unit 21. The movement controller 158 controls the operation of the conveying motor 147 (see FIG. 1), etc.

Figure 8:
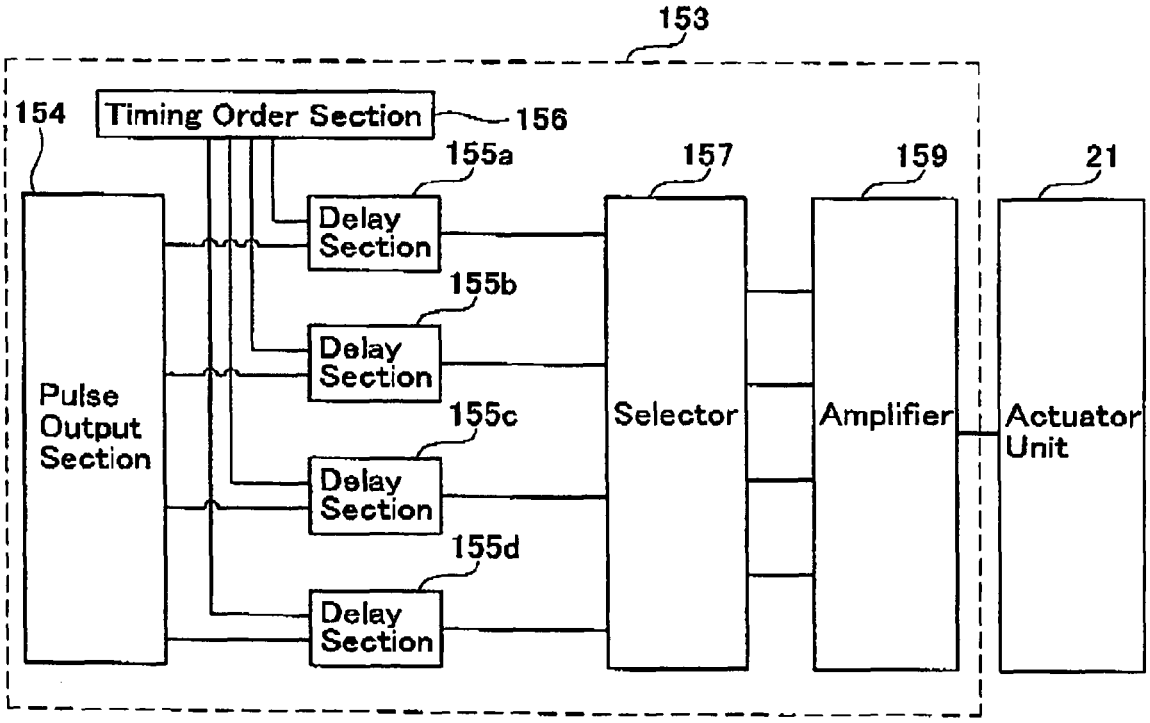
FIG. 8 shows the configuration of an actuator controller.

The aforementioned parts are hardware items formed from ASICs (Application Specific Integrated Circuits), or the like. However, all or part of the hardware items may be formed from software FIG. 8 shows the configuration of the actuator controller 153. The actuator controller 153 comprises a pulse output section 154, four delay sections 155*a* to 155*d*, a timing order section 156, a selector 157, and an amplifier 159. The pulse output section 154, the delay sections 155*a* to 155*d*, the timing order section 156, and the selector 157 are formed from digital circuits. The amplifier 159 is formed from analog circuit.

The pulse output section 154 generates pulse signals for discharging ink from the nozzles 8 based on the print data output from the communication section 151. For example, if three ink droplets are to be discharged continuously from one nozzle g, the pulse output section 154 outputs three continuous pulse signals.

The four delay sections 155*a* to 155*d* are connected to the pulse output section 154. The delay sections 155*a* to 155*d* input the pulse signals that were output from the pulse output section 154. The delay sections 155*a* to 155*d* cause a delay of a predetermined time in the pulse signals that were input (it may also be the case that the pulse signals are not delayed), and then output the delayed pulse signals. The pulse signals output from the delay sections 155*a* to 155*d* are output to the selector 157. The delay sections 155*a* to 155*d* adopt any of four delay times: zero delay, td delay, td×2 delay, and td×3 delay. Four types of pulse signals in which the time difference is set are output to the selector 157.

Although this will be described in detail later, when two adjacent element lines (for example, G2 and G3) deform simultaneously in the same direction, the structural cross-talk phenomenon occurs between these element lines. The td delay of the present embodiment is set to be a time such that the structural crosstalk phenomenon barely occurs between the two adjacent element lines. In the present embodiment, the smallest time (3.2 μs)—out of the range of times in which the structural cross-talk phenomenon will not occur between two adjacent element lines—has been adopted as the td delay. The value of the td delay can be determined based on the positional relationship of the piezoelectric elements 20 (i.e. arrangement density), or on the rigidity of the piezoelectric sheets 41 to 44, etc.

The selector 157 selects the piezoelectric elements 20 (the individual electrodes 35) to which the pulse signals are to be applied based on the print data output from the PC 200. The selector 157 sends the pulse signals to the selected piezoelectric elements 20 via the amplifier 159. The pulse signals output from the selector 157 are amplified by the amplifier 159. Amplified pulse signals are thus sent to the piezoelectric elements 20 selected by the selector 157. The delays set by the delay sections 155*a* to 155*d* are included in the pulse signals sent from the selector 157. The selector 157 can simultaneously sand pulse signals to all the piezoelectric elements 20 forming one element line, or can simultaneously send pulse signals to any out of the piezoelectric elements 20 in the one element line.

Figures 9, 10:
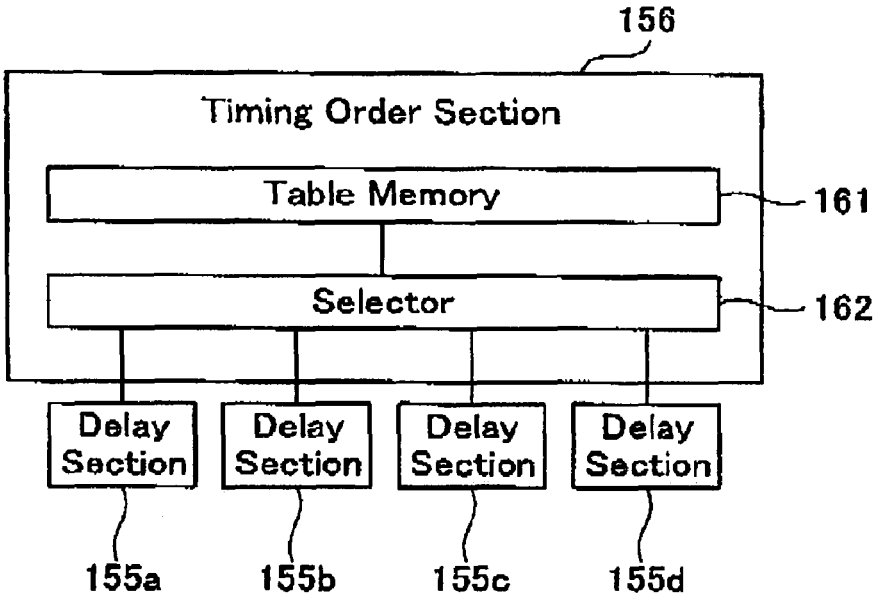
FIG. 9 shows the configuration of a timing order section.
FIG. 10 shows the relationship between ink chambers, pressure chamber lines, nozzle lines, projective points, and delay times.

The timing order section 156 sets the delay (any out of zero delay, td delay, td×2 delay, and td×3 delay) for the delay sections 155*a* to 155*d*. The configuration of the timing order section 156 will be described with reference to FIG. 9. FIG. 9 shows the configuration of the timing older section 156.

The timing order section 156 comprises a table memory 161 and a selector 162. The table memory 161 stores the delays for each of the element lines. FIG. 10 shows an example of the content stored in the table memory 161. The '0' in the Delay column in FIG. 10 means that the delay is zero. '1' means that the delay is td, '2' means that the delay is td×2, and '3' means that the delay is td×3. The table memory 161 stores the delay time td that corresponds to the element line 20*a*. The table memory 161 stores the delay time zero that corresponds to the element line 20*b*. The table memory 161 stores the delay time td×3 that corresponds to the element line 20*c*. The table memory 161 stores the delay time td×2 that corresponds to the element line 20*d*.

In FIG. 10, the relationship is shown between the ink chambers E1 to E4, the pressure chamber lines F1 to F16, the nozzle lines F1' to F16', the projective points (1) to (16), the element lines G1 to G16, and the delay times. The relationship between all the elements of the ink jet head can easily be understood by looking at FIG. 10. For example, the pressure chamber line F1 communicates with the ink chamber E1, and communicates with the nozzle line F1'. The projective point (see FIG. 4) of the nozzle line F1' is (1). The element line G1 is facing the pressure chamber line F1. The delay of the element line G1 is zero.

FIG. 11 is an excerpt of four columns of FIG. 10, namely the projective points, the ink chambers, the nozzle lines, and the delay times. FIG. 11 is shown by the sequence of the projective points. As shown in FIG. 1I, the ink is discharged from two nozzles 8 that have two adjacent projective points with differing timing. For example, ink is discharged from the nozzle 8 with the projective point (1) at the delay dine zero, and ink is discharged from the nozzle 8 with the projective point (2) at the delay time td×2. Further, two nozzles 8 that have two adjacent projective points correspond to different ink chambers. For example, the nozzle 8 with the projective point (1) corresponds to the ink chamber E1, and the nozzle 8 with the projective point (2) corresponds to the ink chamber E4.

The selector 162 of FIG. 9 sets the delay times stored in the table memory 161 for the delay sections 155*a* to 155*d*. In the present embodiment, the selector 162 sets the td delay for the delay section 155*a*, sets the zero delay for the delay section 155*b*, sets the td×3 delay for the delay section 155*c*, and sets the td×2 delay for the delay section 155*d*. Consequently, the delay section 155*a* outputs pulse signals that contain td delay, the delay section 155*b* outputs pulse signals that contain zero delay, the delay section 155*c* outputs pulse signals that contain td×3 delay, and the delay section 155*d* outputs pulse signals that contain td×2 delay.

The delay section 155*a* (see FIG. 8) corresponds to the pressure chamber lines 11*a* (see FIG. 3). That is, the delay section 155*a* corresponds to the nozzle lines 15*a* (see FIG. 4) and to the element lines 20*a* (see FIG. 6). The pulse signals output from the delay section 155*a* are sent to the piezoelectric elements 20 (the individual electrodes 35) forming the element lines 20*a*. Similarly, the delay sections 155*b* to 155*d* correspond to the pressure chamber lines 11*b* to 11*d*, the nozzle lines 15*b* to 15*d*, and the element lines 20*b* to 20*d*. The pulse signals output firm the delay section 155*b* are sent to the piezoelectric elements 20 forming the element lines 20*b*. The pulse signals output from the delay section 155*c* are sent to the piezoelectric elements 20 forming the element lines 20*c*, and the pulse signals output from the delay section 155*d* are sent to the piezoelectric elements 20 forming the element lines 20*d*.

The selector 157 of FIG. 8 stores the relationship between the delay sections 155*a* to 155*d* and the element lines G1, etc. The selector 157 can send the pulse signals output from the delay section 155*a* to the element lines 20*a* that correspond to the delay section 155*a*. Similarly, the selector 157 can send the pulse signals output from each delay section 155*b* to 155*d* to the corresponding element line 20*b* to 20*d*.

Figure 12:
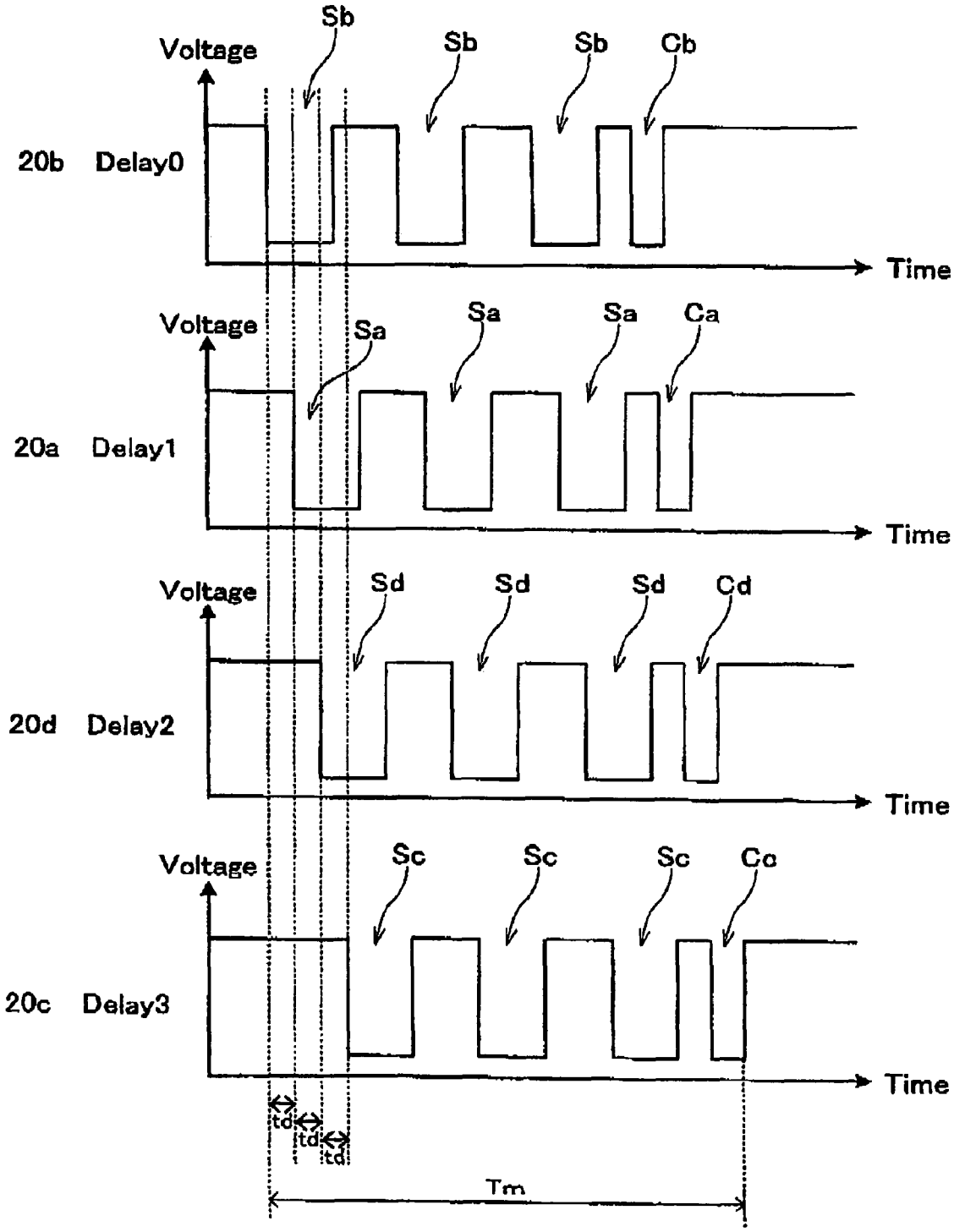
FIG. 12 shows an example of pulse signals applied to four element lines that correspond to one ink chamber.

As shown in FIG. 10, differing delays are set for the four element lines 20*a* to 20*d* that correspond to the same ink chamber (sic) E1, etc. Consequently, the voltage of, for example, the element lines G1 to G4 can be changed with differing timing. The way in which the voltage of the element lines 20*a* to 20*d* is changed is described with reference to FIG. 12. FIG. 12 shows the pulse signals supplied to the element lines 20*a* to 20*d* (the voltage applied to the element lines 20*a* to 20*d*). Moreover, in the graphs of FIG. 12, time is shown on the horizontal axis, and voltage is shown on the vertical axis.

In the present embodiment, pulse signals in which the high voltage is the standard are supplied to the piezoelectric elements 20. In the examples in FIG. 12, the pulse signals supplied to the piezoelectric elements 20 consist of three discharge pulses S and one cancel pulse C. In FIG. 12, the discharge pulses supplied to the element lines 20*a* are represented by Sa, and the cancel pulse supplied to the element lines 20*a* is represented by Ca. Similarly, the discharge pulses supplied to the element lines 20*b* to 20*d* are represented by Sb to Sd, and the cancel pulses supplied to the element lines 20*b* to 20*d* are represented by Cb to Cd.

One discharge pulse S is used to discharge one ink droplet from the nozzle 8. When the voltage changes from the high voltage to the low voltage, the piezoelectric element 20 deforms in the direction of decreasing the pressure of the pressure chamber 10 (see FIG. 5). The ink is thus lead into the pressure chamber 10 from the ink chamber E1. Next, the voltage changes from the low voltage to the high voltage. Then the piezoelectric element 20 deforms in the direction of increasing the pressure of the pressure chamber 10. The ink within the pressure chamber 10 is thus pressurized, and one irk droplet is discharged from the nozzle 8. Three ink droplets are discharged from the nozzle 8 when this is repeated three times.

The cancel pulse C is used to remove remaining pressure within an ink passage which is a passage from the ink chamber E1, etc. via the pressure chamber 10 to the nozzle 8. A pressure having a period that is the reverse of the period of the remaining pressure is generated in the ink passage by applying the cancel pulse C to the piezoelectric element 20. The remaining pressure can thus be removed.

The delay is zero in the pulse signals Sb supplied to the element lines 20*b*. Here, the pulse signals Sb supplied to the element lines 20*b* will be termed standard pulse signals. The delay is td in the pulse signals Sa supplied to the element lines 20*a*. The delay is td×2 in the pulse signals Sd supplied to the element lines 20*d*, and is td×3 in the pulse signals Sc supplied to the element lines 20*c*.

Figure 13:
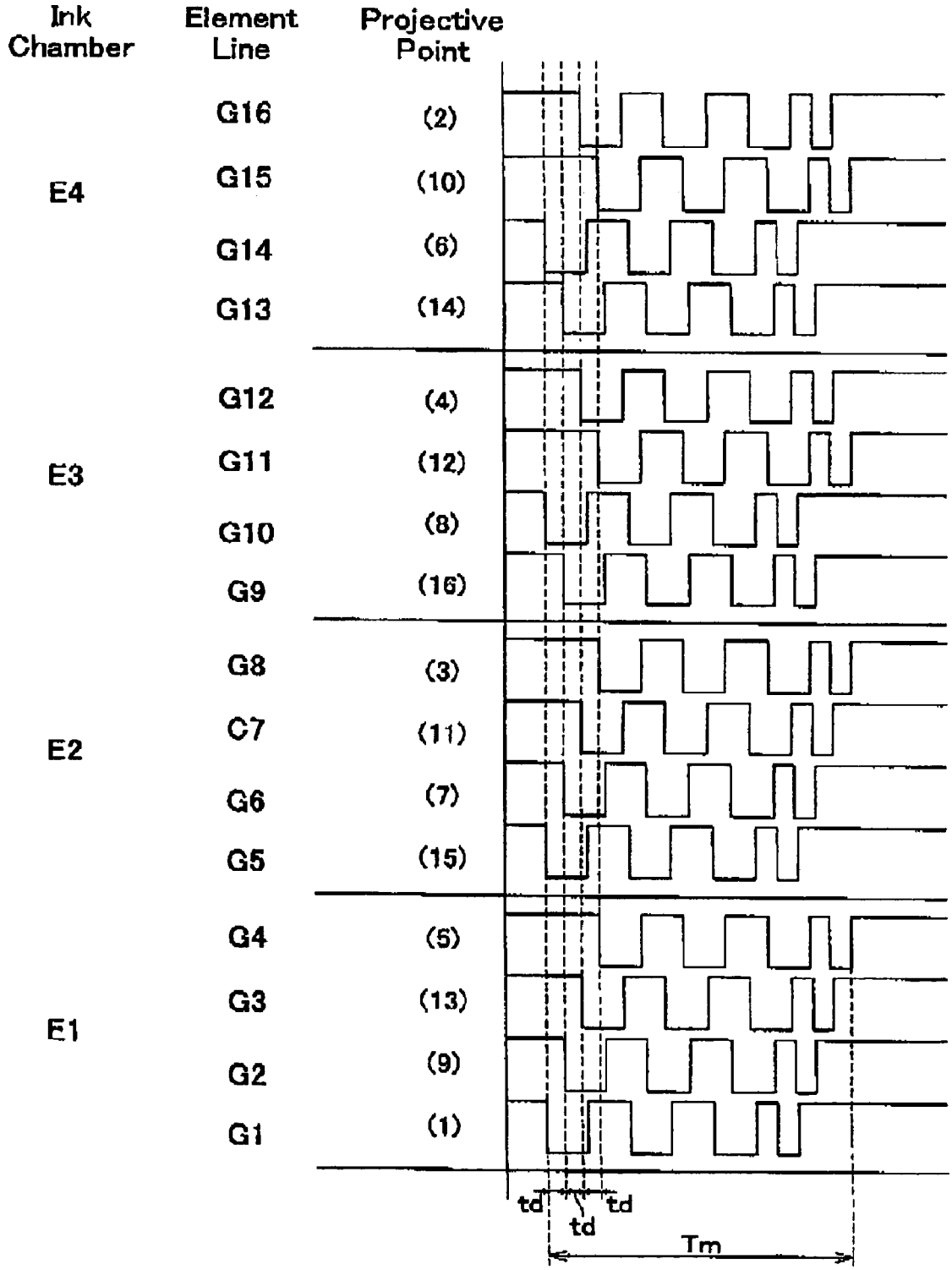
FIG. 13 shows an example of pulse signals applied to sixteen element lines.

FIG. 13 shows the pulse signals supplied to the element lines G1 to G16. Pulse signals are supplied with differing timings to the four element lines G1 to G4 that correspond to the ink chamber E1. Further, pulse signals are supplied with differing timings to the four element times G5 to G8 that correspond to the ink chamber E2. Pulse signals are supplied with differing timings to the four element lines G9 to G12 that correspond to the ink chamber E3, and pulse signals are supplied with differing timings to the four element lines G13 to G16 that correspond to the ink chamber E4.

The configuration of the printer 1 of the present embodiment will be described in detail. When the printer 1 is configured as described above, it is possible to prevent the structural cross-talk phenomenon from occurring between two adjacent element lines G1, etc. This is described with reference to FIG. 6.

Pulse signals may be supplied simultaneously to, for example, piezoelectric elements G2-1 and G2-2 that form the element line G2. That is, the piezoelectric elements G2-1 and G2-2 may simultaneously deform in the same direction. Further, pulse signals may be supplied simultaneously to, for example, piezoelectric elements G3-1, G3-2, G3-3 that form the element line G3. That is, the piezoelectric elements G3-1, G3-2, G3-3 may simultaneously deform in the same direction.

As shown in FIG. 6, two adjacent piezoelectric elements (for example, G2-1, G2-2) that are included in the same element line (for example, G2) have the apexes of their diamond shapes mutually facing one another. That is, a bisector of an obtuse angle of one diamond shape is consistent with a bisector of an obtuse angle of the other diamond shape. The present inventors found from their research that the structural cross-talk phenomenon does not readily occur between the two adjacent piezoelectric elements G2-1 and G2-2 when their apexes face one another. In the present embodiment, the two adjacent piezoelectric elements (for example, G2-1 and G2-2) included in the same element line are hardly affected by the structural cross-talk phenomenon.

By contrast, two adjacent element lines (for example, G2 and G3) may be easily affected by the structural cross-talk phenomenon. The reason therefore could be assumed to be as follows: the side of the diamond of each piezoelectric element (G2-1, G2-2, etc.) of the element line G2 is facing the side of each piezoelectric element (G3-1, G3-2, G3-3, etc.) of the element line G3. Further, the present inventors found from their research that the effects of the structural cross-talk phenomenon are particularly strong when two adjacent element lines (for example, G2 and G3) are deformed simultaneously in the same direction. For example, they found that if the piezoelectric elements G2-1, G2-2, G3-1, G3-2, and G3-3 are deformed simultaneously in the same direction, the effects of the structural cross-talk phenomenon are stronger than when only the piezoelectric elements G2-1 and G3-1 are deformed simultaneously in the same direction. That is, the piezoelectric elements G2-1, etc. have a smaller amount of deformation when the piezoelectric elements G2-1, G2-2, G3-1, G3-2, and G3-3 are deformed simultaneously in the same direction than when only the piezoelectric elements G2-1 and G3-1 are deformed simultaneously.

In the present embodiment, the piezoelectric elements G2-1 and G2-2 of the element line G2 are deformed using a pulse signal containing the delay time td (see FIG. 10, etc.). Further, the piezoelectric elements G3-1, G3-2, and G3-3 of the element line G3 are deformed using a pulse signal containing the delay time td×2 (see FIG. 10, etc.).

There is a time difference between the timing at which the piezoelectric elements G2-1 and G2-2 of the element line G2 deform simultaneously in the same direction and the timing at which the piezoelectric elements G3-1, G3-2, and G3-3 of the element line G3 deform simultaneously in the same direction. The present inventors found from their research that the structural cross-talk phenomenon can be prevented from occurring between the two adjacent element lines (for example, G2 and G3) when there is a time difference in the pulse signals of the two adjacent element lines (for example, G2 and G3). In the printer 1 of the present embodiment, the structural cross-talk phenomenon can be prevented from owing between two adjacent element lines. In the printer 1 of the present embodiment, the structural cross-talk phenomenon that exerts a large effect on adjacent element lines can effectively be prevented.

Furthermore, the td delay in the present embodiment has been set to be the smallest time (3-2 μs) out of the range of times in which the structural cross-talk phenomenon will not occur between two adjacent element lines. Consequently, a period Tm between the time when a first discharge pulse Sb is supplied to the element lines 20*b* and the time when a cancel pulse Cc is supplied to the element lines 20*c* can be shortened (see FIG. 12).

The time required for the print paper P to be conveyed a standard distance (approximately 40 μm)—this corresponding to the printing resolution (600 dpi) in the conveying direction P3—is termed a printing period. Ink (one droplet, two droplets, or three droplets) is discharged from each nozzle 8 during one printing period. In the present embodiment, a period Tm can be made shorter, and consequently the printing period can be made shorter. That is, rapid printing can be realized.

Further, since voltage is applied to the element lines 20*a* to 20*d* with timings that have been divided into four differing types, it is possible to reduce peaks in energy consumption. When the technique of the present embodiment is adopted, a smaller and simpler power source device may be used.

In the present embodiment, the timing at which the pulse signals are supplied is set by the element line. Further, the element lines G1, etc. extend in the A direction that is orthogonal to the conveying direction P3 of the print paper P. The nozzles 8 that correspond to the piezoelectric elements 20 of the same element line can thus be aligned in a straight line in the A direction. Consequently, the arrangement of the nozzles 8 is not rendered more complex.

The effects of a fluid cross-talk phenomenon are increased when pressure of the four pressure chamber lines 11*a* to 11*d* (see FIG. 3, etc.) that communicate with the same ink chamber (for example, E1) is simultaneously increased or reduced. The fluid cross-talk phenomenon is a phenomenon in which pressure waves generated in the pressure chambers 10 that communicate with the same ink chamber overlap within the ink chamber and are amplified, thus affecting ink discharge performance. When the fluid cross-talk phenomenon occurs, the ink might be discharged at unintended timings, and might be discharged in an unintended quantity.

In the present embodiment, as shown in FIG. 10, the pressure of the four pressure chamber lines 11*a* to 11*d* that communicate with the same ink chamber is increased or reduced with differing timings. Consequently, there is a difference in phase of the pressure waves generated by the pressure chamber lines 11*a* to 11*d*. The phenomenon of the pressure waves being amplified within the ink chambers can thus be prevented. The fluid cross-talk phenomenon can thus be prevented from occurring.

In the aforementioned embodiment, the four ink chambers E1 to E4 are used. However, only one ink chamber may also be used. That is, a configuration in which all the pressure chambers 10 communicate with one ink chamber may be adopted. In this case, the amount of ink discharged from the nozzles 8 will tend to differ when the timing at which the ink is discharged differs. This is because the effects of the fluid cross-talk phenomenon by pressure wave within the ink chamber differ. When the amount of ink differs, the dots (the points formed on the print paper by the ink) formed on the print paper P will differ in size. For example, when ink is discharged at different timings from two nozzles 8 that form two adjacent projective points (see FIG. 4), the two dots that are adjacent in the direction A will tend to have differing sizes. By contrast, when ink is discharged with the same timings from two nozzles 8 that form two adjacent projective points) the two adjacent dots tend to have the same size. In the latter case, both of the two adjacent dots may be either large or small. In this case, there is a possibility that large dots are continuously formed in the A direction and small dots am continuously formed at a position located adjacent to the large dots. This may cause the user to perceive a large difference between the density of the large dots and the density of the small dots. By contrast, the two adjacent dots will have differing sizes in the former case, and consequently differences in density are not easily perceived when the entire print paper P is viewed. The former case allows satisfactory printing to be achieved.

In the present embodiment, as shown in FIG. 11, two nozzles 8 that form two adjacent projective points discharge ink at different timings. Satisfactory printing can consequently be achieved.

The present inventors found from their research that the effects of the fluid cross-talk phenomenon vary for each ink chamber. As a result, two nozzles 8 that communicate with different ink chambers (for example, E1 and E2) will tend to discharge differing amounts of ink. For example, if two nozzles 8 that form two adjacent projective points communicate with the same ink chamber E1, the two adjacent dots in the A direction may have the same size. By contrast, if two nozzles 8 that from two adjacent projective points communicate with different ink chambers E1 and E2, the two adjacent dots in the A direction may have differing sizes. The latter case allows satisfactory printing to be achieved.

In the present embodiment, two nozzles 8 that form two adjacent projective points communicate with different ink chambers. Satisfactory printing can consequently be achieved.

In the present embodiment, the pressure chamber lines F1 to F16, the nozzle lines F1' to F16', the element lines G1 to G16, and the ink chambers R1 to E4 extend in a uniform direction (the A direction). The pressure chamber lines F1 to F16, the nozzle lines F1' to F16', the element lines G1 to G16, and the ink chambers E1 to E4 are disposed in a regular manner. Consequently, the effects of the structural cross-talk phenomenon and the fluid cross-talk phenomenon tend to be uniform in one element line. As a result, an artifice for reducing the effects of both cross-talk phenomena may be implemented easily.

Second Embodiment

Figure 14:
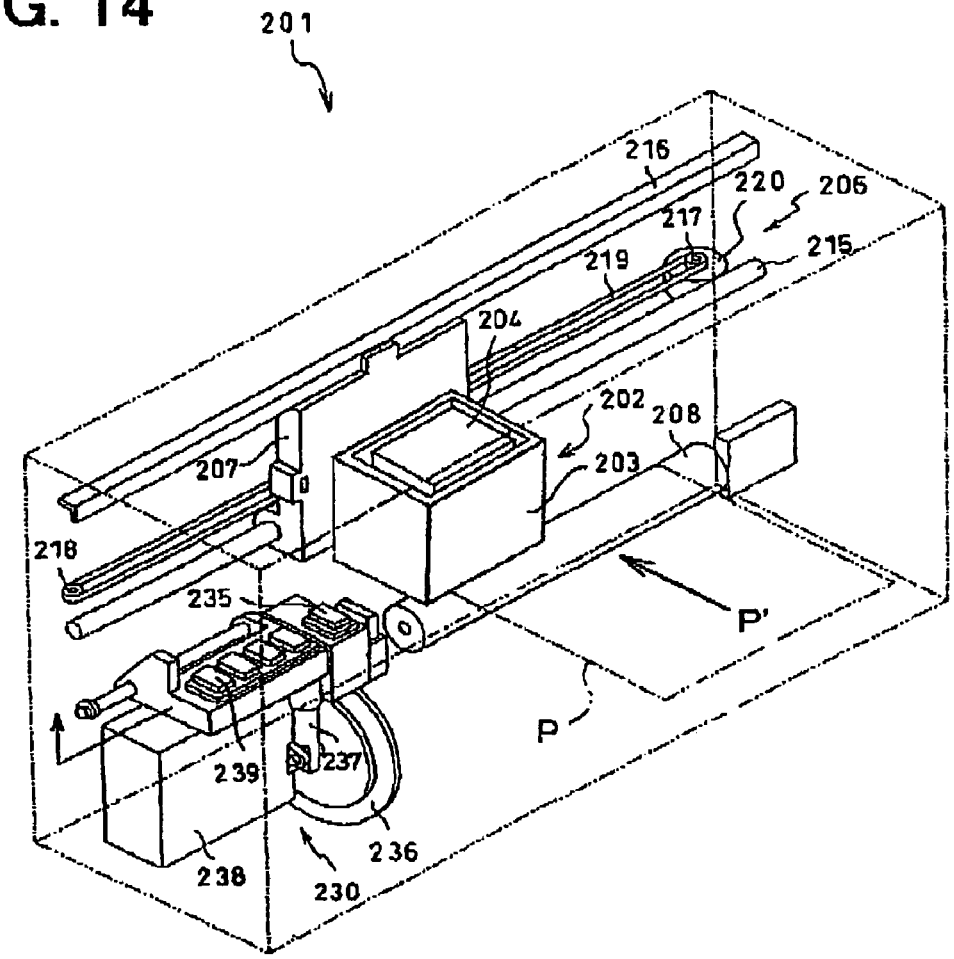
FIG. 14 shows a schematic block diagram of an ink jet printer of a second embodiment.

Next, an ink jet printer 201 of a second embodiment will be described. The printer 1 of the first embodiment is a line type ink jet printer. By contrast, the printer 201 of the present embodiment is a serial type ink jet printer. FIG. 14 shows a schematic perspective view of the printer 201 of the second embodiment.

The printer 201 comprises a head unit 202. An ink tank 204 that stores black ink, and an ink jet head 205 (see FIG. 15) are fixed to a holder 203 of the head unit 202. A plurality of nozzles (not shown) is formed at a lower face of the ink jet head 205. The holder 203 is maintained in a carriage 207. The carriage 207 is supported in a manner allowing sliding on a guide axis 215. A guide axis 216 that guides the carriage 207 makes contact with an upper face of the cage 207.

A driving structure 206 comprises pulleys 217 and 218, a belt 219, a motor 220, etc. The belt 219 is wound across the pulleys 217 and 21. The carriage 207 is fixed at a predetermined position to the belt 219. The motor 220 is connected to the pulley 217. The pulley 217 rotates when the motor 220 is performing the driving operation, and the belt 219 thus rotates. When the belt 219 rotates, the carriage 207 moves along the guide axis 215. When the carriage 207 moves, the bead unit 202 also moves.

A platen roller 208 conveys print paper P in the direction of the arrow P'. An axis of the platen roller 208 is disposed parallel with the guide axis 215.

The print paper P is transported in the direction of the arrow P' between the ink jet head 205 and the platen roller 208. The ink jet head 205 prints onto the print paper P by discharging ink.

The ink jet printer 201 comprises a purge mechanism 230. The purge mechanism 230 is a purge cap 235. The purge cap 235 can cover a part of the lower face of the ink jet head 205. A pump 237 is driven while the purge cap 235 is covering the lower face of the ink jet head 205. Ink containing air bubbles, waste, etc. within the ink jet head 205 is thus sucked away. The ink that has been sucked away is housed in an ink store 238. Moreover, a cam 236 is provided for moving the purge cap 235 upwards or downwards with respect to the ink jet head 205.

Four caps 239 cover nozzles of the ink jet head 205 when printing is not being performed. The ink can thus be prevented from drying out.

Figure 15:
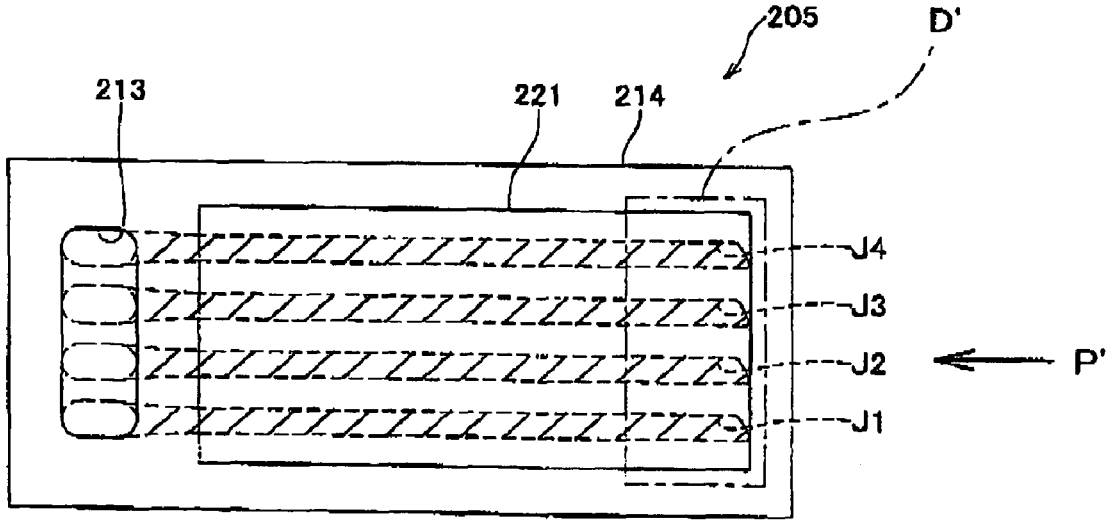
FIG. 15 shows a plan view of an ink jet head of the second embodiment.

FIG. 15 shows a plan view of the ink jet head 205 of the present embodiment. When viewed from a plan view, the ink jet head 205 has a rectangular shape extending in a conveying direction P' of the print paper P. The ink jet head 205 comprises a passage unit 214 and an actuator unit 221, etc. The actuator unit 221 is connected to an upper surface (a surface of the proximate side in a direction perpendicular to the plane of FIG. 15) of the passage unit 214. The passage unit 214 has a configuration the same as the passage unit 4 of the first embodiment. Four ink supply holes 213 are formed in the upper surface of the passage unit 214. An ink tank 204 (see FIG. 14) is connected to these four ink supply holes 213. One of the ink supply holes 213 is connected to one ink chamber (any out of J1 to J4). In the present embodiment, the four ink chambers J1 to J4 are formed within the passage unit 214.

Figure 16:
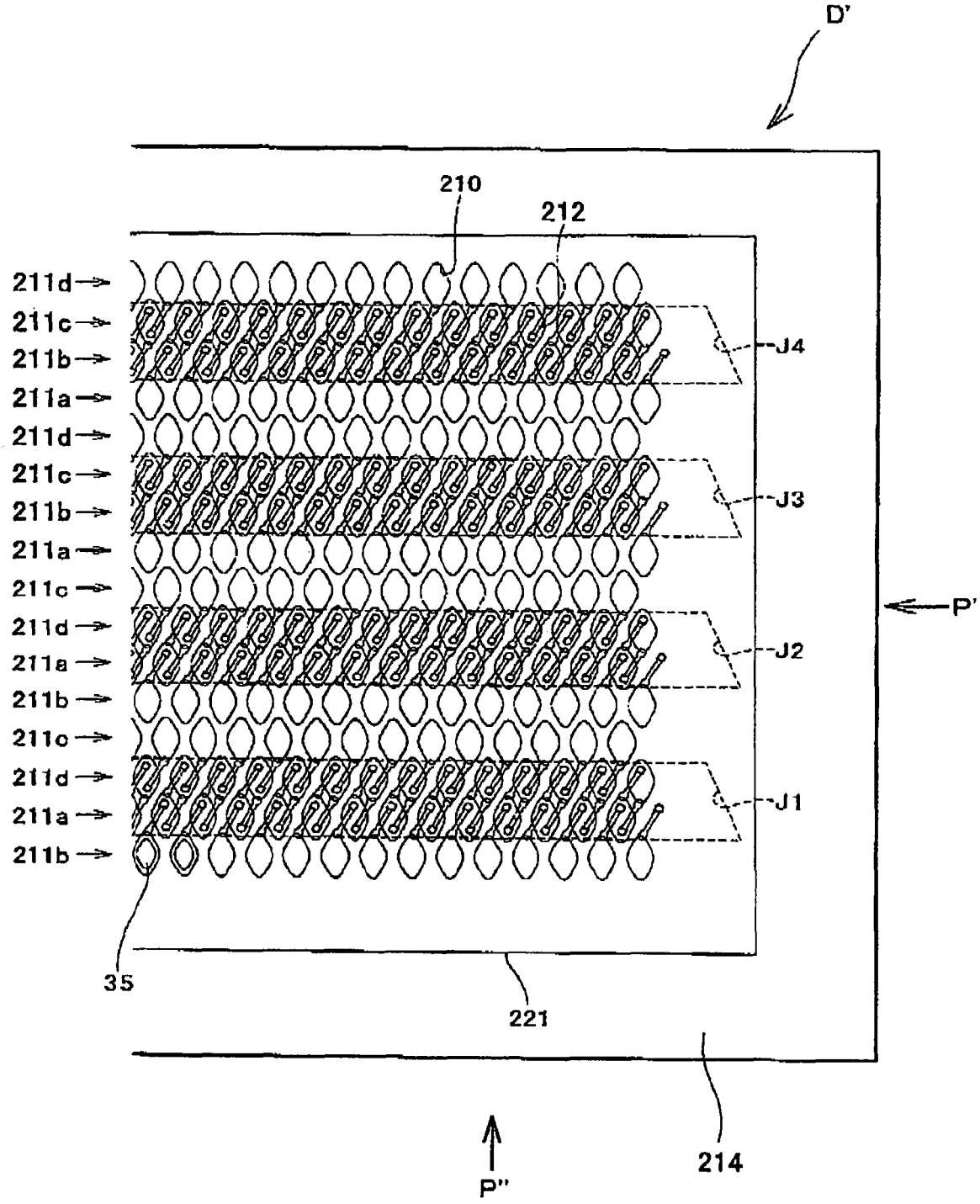
FIG. 16 shows an expanded view of a region D' of FIG. 15.

FIG. 16 shows an expanded plan view of a region D' of FIG. 15. In FIG. 16, pressure chambers 210 and apes 212 which actually cannot be seen in FIG. 16 are shown by solid lines.

In the passage unit 214, the ink chambers J1 to J4, the pressure chambers 210, the apertures 212 and the nozzles (not shown) have the same positional relationship as in the first embodiment. Sixteen pressure chamber lines 211*a* to 211*d* are formed. Four pressure chamber lines 211*a* to 211*d* communicate with one ink chamber (any out of J1 to J4). Further, sixteen nozzle lines (not shown) are formed. The nozzles are mutually offset in the conveying direction P' of the print paper P. Ink is discharged while the carriage 207 is moving in the direction shown by the arrow P". Since printing is performed while the ink jet head 205 is moving with respect to the print paper P in the direction of the arrow P' and arrow P". The print paper is conveyed a predetermined distance in the direction of P', and then the ink jet head 205 is moved in the direction of P". After that, the print paper is conveyed the predetermined distance in the direction of P', and then the ink jet head 205 is moved in the direction of P'. This cycle is repeated. Therefore, the entire range of the print paper P can be printed.

Like the first embodiment, the resolution density in the direction of the arrow P' is 600 dpi.

The configuration of the actuator unit 221 is approximately the same as the configuration of the actuator unit 21 of the first embodiment. The actuator unit 221 of the present embodiment differs from the first embodiment in the aspect of its plan shape being rectangular. Sixteen element lines (not shown) are formed in the actuator unit 221 so as to correspond to the pressure chamber lines 211*a* to 211*d*.

The printer 201 of the present embodiment comprises a control section (not shown) that executes controls that axe almost identical with the controller 100 of the first embodiment. The control section of the present embodiment differs from the fist embodiment in the aspect of performing printing while moving the carnage 207. As in the first embodiment, the control section of the present embodiment supplies pulse signals containing a delay td to the element lines that correspond to the pressure chamber lines 211*a*. Pulse signals containing a delay zero are supplied to the element lines that correspond to the pressure chamber lines 211*b*. Pulse signals containing a delay td×3 are supplied to the element lines that correspond to the pressure chamber lines 211*c*, and pulse signals containing a delay td×2 are supplied to the element lines that correspond to the pressure camber lines 211*d*.

With the printer 201 of the present embodiment, the structural cross-talk phenomenon can be preventing from occurring between two adjacent element lines. Further, the fluid cross-talk phenomenon can be preventing from occurring in the ink chambers J1 to J4. Moreover, pas in energy consumption can be reduced, and a power source device may be made smaller and simpler.

Various modifications may be made to the aforementioned embodiments. Some representative modifications to the aforementioned embodiments are listed here.

(1) The selector 162 of the first embodiment (see FIG. 9) supplies pulse signals with a fixed delay pattern to the element lines 20*a* to 20*d*. For example, pulse signals that contain the delay td are usually supplied to the element line 20*a*. However, the delay pattern of the pulse signals supplied to the element lines 20*a* to 20*d* may change over time. For example, the delay pattern of the pulse signals supplied to the element lines 20*a* to 20*d* may be changed each time print data is input. As another example the delay pattern of the pulse signals may be changed in each printing period.

(2) In ale aforementioned embodiments, pulse signals with four types of delay pattern were adopted. However, the number of types of delay patterns is not limited to four. Any number of types of delay patterns may be adopted as long as the number is at least two. If there are two types of delay patterns, the timing for driving two adjacent element lines (for example, G1 and G2) can be changed.

(3) It is preferred that ink is discharged from two nozzles that form two adjacent projective points at differing timings. However, a configuration in which these timings match may also be used.

(4) The ink chambers E1 to E4 (J1 to J4) of the aforementioned embodiments extend parallel to the longitudinal direction of the passage unit 4 (214). However, as shown in FIG. 17, ink chambers H1 to H4 need not extend parallel to the longitudinal direction of a passage unit 304.

Figure 17:
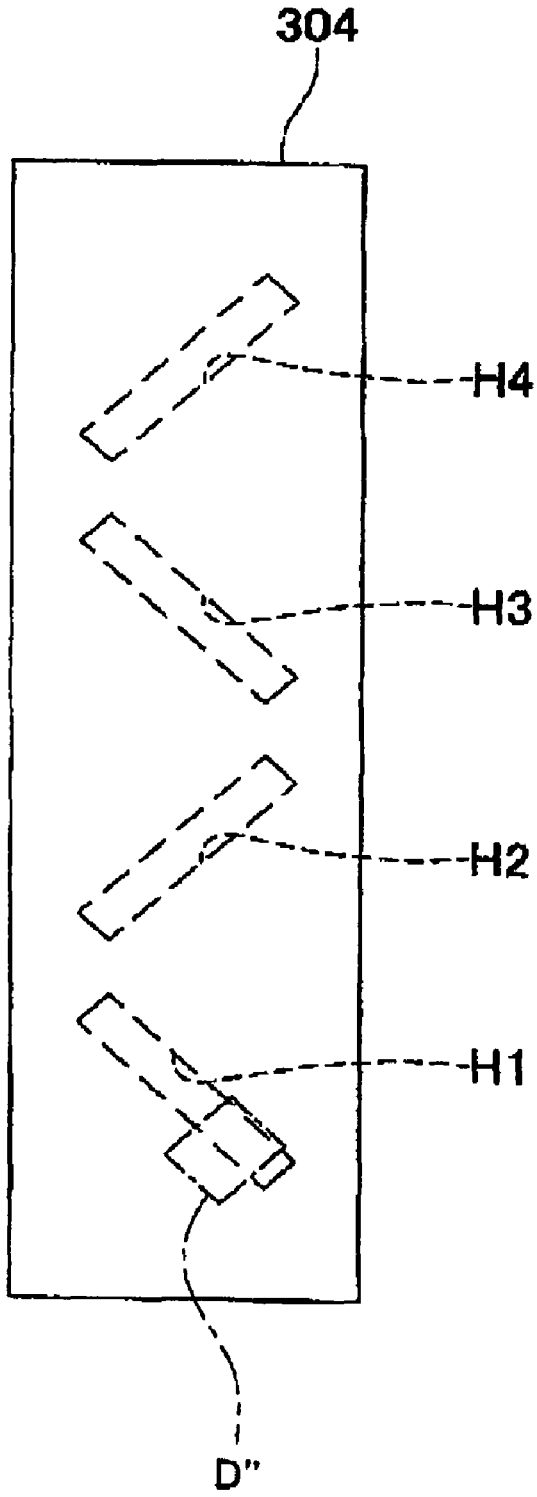
FIG. 17 shows a variant example of a passage unit of the ink jet head.

As shown in FIG. 17, the four ink chambers H1 to H4 of the current variant extend in directions that are inclined by predetermined angles with respect to the longitudinal direction of the passage unit 304. The ink chambers H1 and H3 are mutually parallel. The ink chambers H2 and H4 are mutually parallel. The ink chambers H1 and H2 are inclined in opposing directions.

Figure 18:
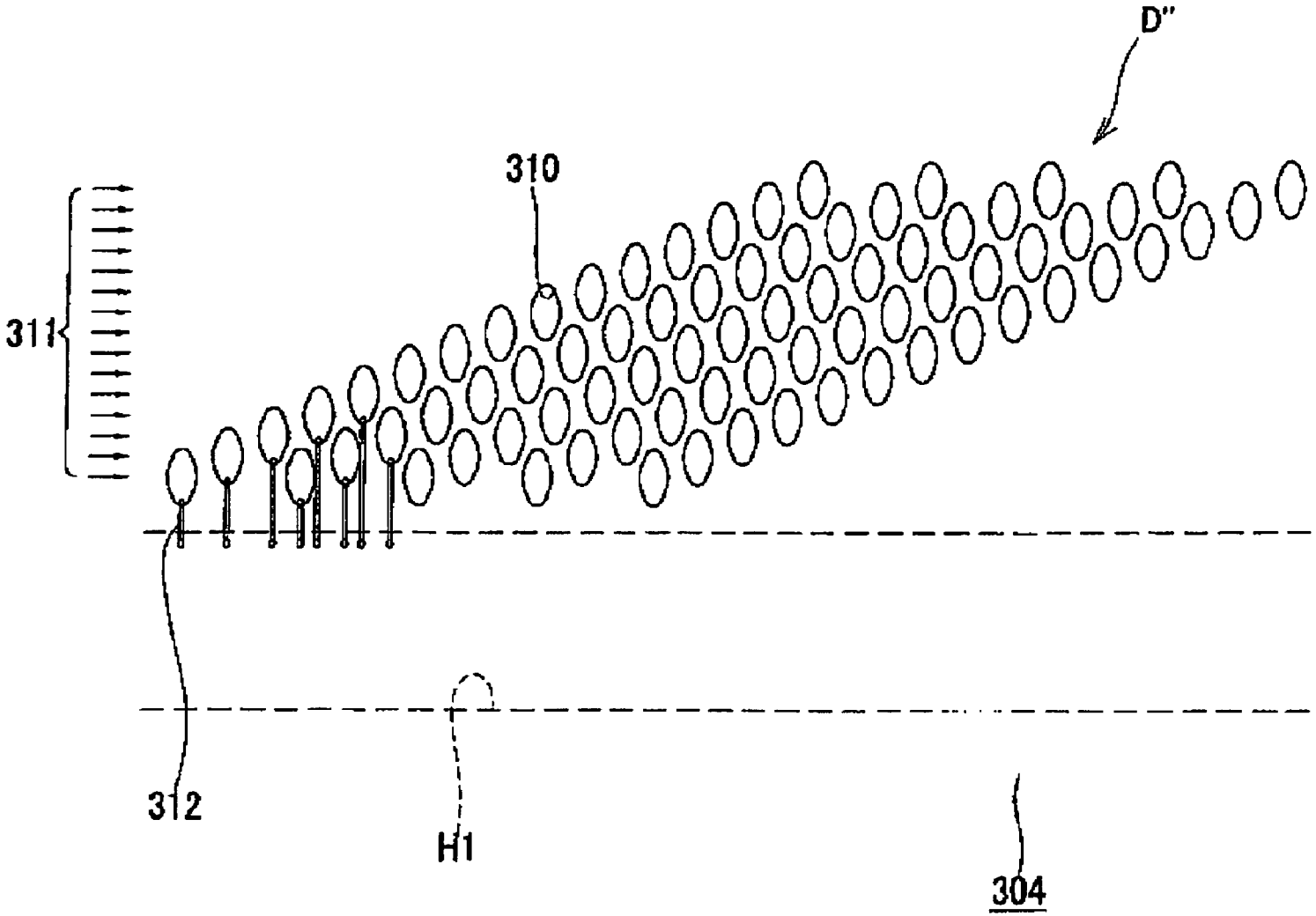
FIG. 18 shows an expanded view of a region D" of FIG. 17.

FIG. 18 shows an expanded plan view of a region D" of FIG. 17. In FIG. 18, apertures 312 which actually cannot be seen in FIG. 18 are shown by solid lines. As shown in FIG. 18, a plurality of pressure chambers 310 is disposed in a matrix shape in the passage unit 304. The plurality of pressure chambers 310 that communicate with the ink chamber H1 form a pressure chamber lines 311 as follows: one pressure chamber line 311 is formed from the plurality of pressure chambers 310 that are aligned in the direction in which the ink chamber H1 extends. The pressure chambers 310 that communicate with the other ink chambers H2 to 114 form pressure chamber lines 311 in the same manner.

The apertures 312 extend in a direction orthogonal to the direction in which the ink chambers H1 to H4 extend. The length of each aperture 312 differs according to the position of the pressure chamber 310 with which the aperture 312 communicates. In the present variant, each aperture 312 which has different length also has different cross-sectional area. Short apertures 312 have a smaller cross-sectional area, and long apertures 312 have a larger cross-sectional area. Flow resistance of each apertures 312 is thus constant.

A plurality of nozzles is disposed in a matrix shape in the lower surface of the passage unit 304. An actuator unit (not shown) is formed at the upper surface of the passage unit 304. This actuator unit has approximately the same configuration as the actuator unit 21 of the first embodiment.

In his representative variant, as well, pulse signals containing differing delay times arm supplied to two adjacent element lines. The same results can thus be obtained as in the aforementioned embodiments.

Figure 19:
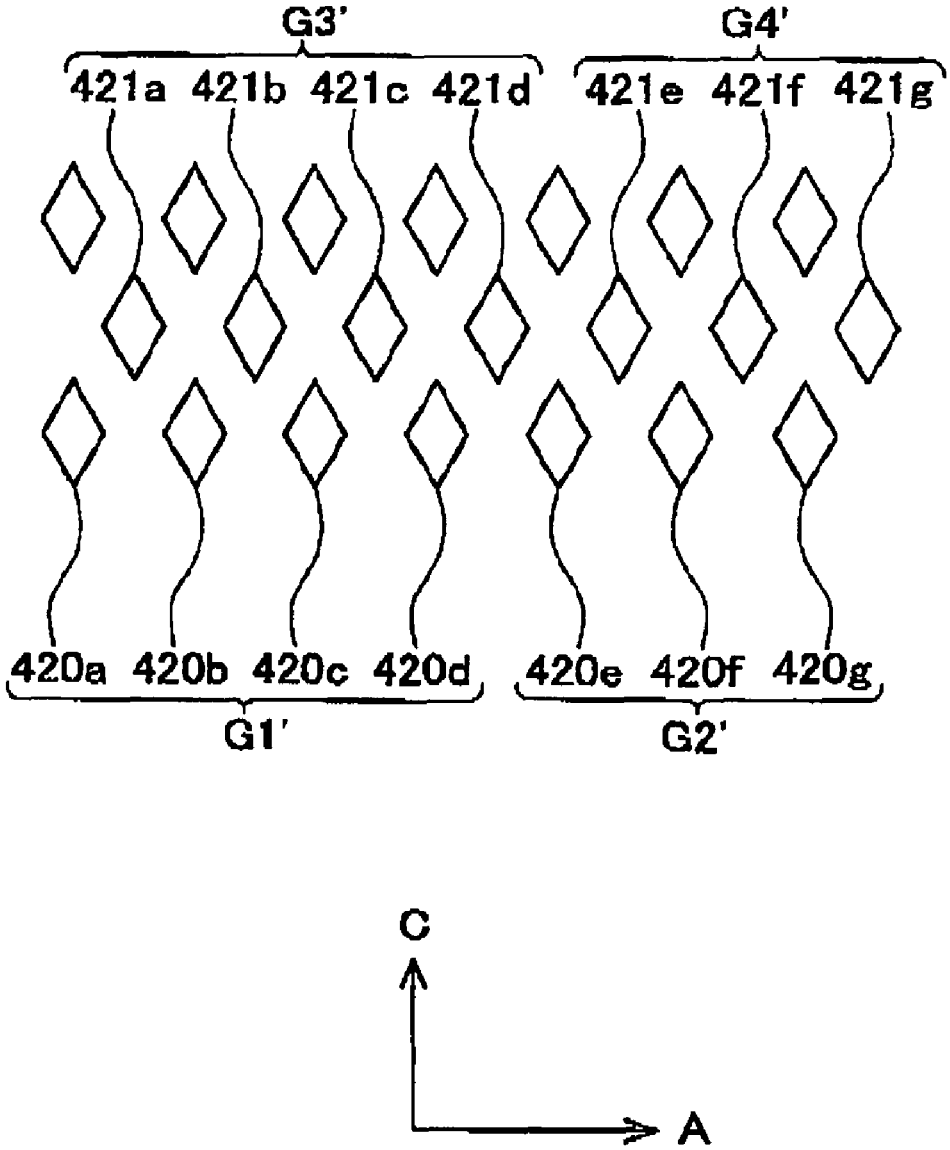
FIG. 19 shows a variant example of a present embodiment.
Figure 20:
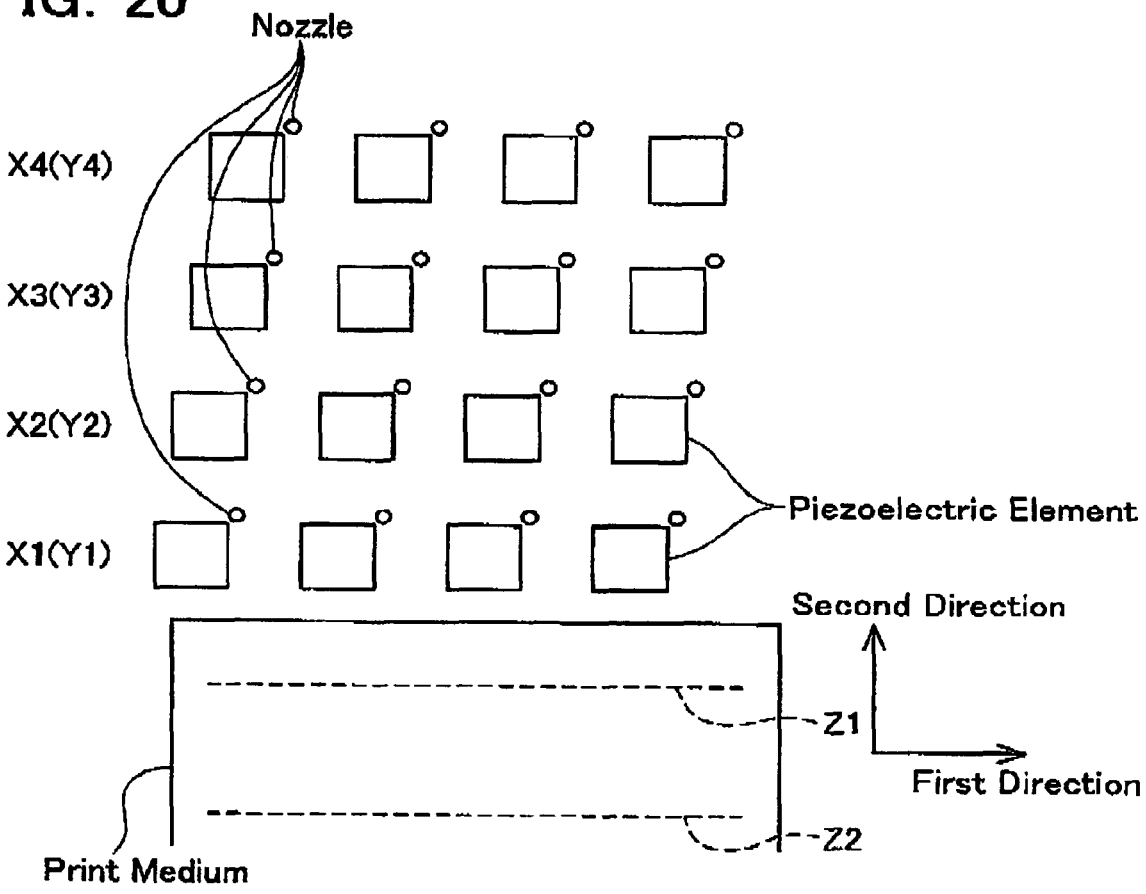
FIG. 20 shows a simplified view of element lines and nozzle lines.

(5) The element lines can be represented in the following manner. FIG. 19 is a plan view showing a simplification of piezoelectric elements 420*a* to 420*g*, 421*a* to 421*g*. This variant is a line type ink jet printer. The direction of the arrow C in FIG. 19 is the direction in which print paper is conveyed.

The piezoelectric elements 420*a* to 420*g* are aligned in the A direction. The piezoelectric elements 421*a* to 421*g* are aligned in the A direction. An element line G1' is formed from the piezoelectric elements 420*a* to 420*d*, and an element line G2' is formed from the piezoelectric elements 420*e* to 420*g*. An element line G3' is formed from the piezoelectric elements 421*a* to 421*d*, and an element line G4' is formed from the piezoelectric elements 421*e* to 421*g*. The element line G1' and the element line G3' are aligned in the C direction, and the element line G2' and the element line G4' are aligned in the C direction.

Pulse signals supplied to the element line G1' and pulse signals supplied to the element line G3' contain differing delay times. Pulse signals supplied to the element line G2' and pulse signals supplied to the element line G4' contain differing delay times. The pulse signals supplied to the element lines G1' and 2' may have the same delay times, or may have differing delay times. The pulse signals supplied to the element lines G3' and 04' may have the same delay times, or may have differing delay times.

As shown in the present variant, one element line need not be formed from all the piezoelectric elements 420*a* to 420*g*, etc. aligned in one direction. The structural cross-talk phenomenon can be prevented from occurring between the element line G1' and the element line G3' even if the present variant is adopted. The structural cross-talk phenomenon can also be prevented from occurring between the element line G2' and the element line G4'.

What is claimed is:

1. An ink jet printer, comprising:

an ink jet head that prints on a print medium by discharging ink, the ink jet head comprising a plurality of units, each unit comprising a nozzle for discharging ink, a pressure chamber communicating with the nozzle, and a piezoelectric element facing the pressure chamber, wherein the piezoelectric elements form at least two element lines in a first predetermined plane, and each element line is formed by at least two piezoelectric elements aligned in a first direction and the at least two element lines are aligned in a second direction which is different from the first direction;

a controller that controls the ink jet head to print on the print medium by changing voltage applied to each piezoelectric element of the ink jet head; and a transferring device that transfers the ink jet head and/or the print medium along a third direction in a state in which at least one nozzle of the ink jet head faces the print medium, wherein the third direction is perpendicular to the first direction in the first predetermined plane, wherein the controller controls timings at which the controller changes voltage applied to each piezoelectric element by the element line, a timing at which the controller changes voltage applied to one of the two adjacent element lines is different from a timing at which the controller changes voltage applied to the other of the two adjacent element lines, the nozzles form at least three nozzle lines in a second predetermined plane which is parallel to the first predetermined plane, each nozzle line is formed by at least two nozzles aligned in the first direction and the at least three nozzle lines are aligned in the second direction, each nozzle on one of the at least three nozzle lines is offset from each nozzle on each of the at least two remaining nozzle lines in the first direction, and the units comprising the piezoelectric elements forming the same element line have the nozzles forming the same nozzle line, wherein a projective point is obtained for each nozzle of the at least three nozzle lines by projecting the nozzle in the third direction to a projective line extending in the first direction, each projective point being included in one of a plurality of combinations of two consecutive projective points, wherein each combination includes a projective point obtained for a nozzle of the at least three nozzle lines, the controller controls the ink jet head such that, for each of the combinations, a timing at which a first nozzle having a first projective point of the combination discharges ink is different from a timing at which a second nozzle having a second projective point of the combination discharges ink.

2. The ink jet printer as in claim 1, wherein a timing at which the controller changes voltage applied to one of the two adjacent element lines from a first level to a second level is different from a timing at which the controller changes voltage applied to the other of the two adjacent element lines from the first level to the second level, and a timing at which the controller changes voltage applied to one of the two adjacent element lines from the second level to the first level is different from a timing at which the controller changes voltage applied to the other of the two adjacent element lines from the second level to the first level.

3. The ink jet printer as in claim 1, wherein the element lines form a plurality of element line groups, each element line group is formed by at least two element lines continuously aligned in the second direction, and the controller controls the ink jet head such that timings at which the controller changes voltage applied to each one of the element lines of the same element line group mutually differ.

4. The ink jet printer as in claim 3, wherein the ink jet head further comprises a plurality of ink chambers, each ink chamber corresponds with a different element line group of the element line groups, and the pressure chambers facing the piezoelectric elements included in the same element line group communicate with the ink chamber corresponding with the element line group.

5. The ink jet printer as in claim 4, wherein for each of the combinations, the ink chamber with which the first nozzle of the combination communicates is different from the ink chamber with which the second nozzle of the combination communicates.

6. The ink jet printer as in claim 4, wherein the piezoelectric elements form at least three element lines, each element line is separated from one another by an equal spacing, and each ink chamber extends in the fist direction and each of the ink chambers is aligned in the second direction.

7. The ink jet printer as in claim 1, wherein each piezoelectric element has a substantially polygon shape in the first predetermined plane, and an apex of one of the two adjacent piezoelectric elements forming the same element line and an apex of the other of the two adjacent piezoelectric elements forming the same element line, face each other.

8. The ink jet printer as in claim 1, wherein a time difference between the timing at which the controller changes voltage applied to one of the two adjacent element lines, and the timing at which the controller changes voltage applied to the other of the two adjacent element lines, is substantially equal to a predetermined period for preventing the occurrence of the structural cross-talk phenomenon between the two adjacent element lines.

9. The ink jet printer as in claim 1, wherein each piezoelectric element comprises a common piezoelectric sheet.

10. The ink jet printer as in claim 1, wherein the controller comprises a pulse output section and at least two delay sections, the pulse output section outputs a pulse signal to ea delay section, each delay section inputs the pulse signal output from the pulse output section, each delay section outputs a delayed pulse signal including delay time to the ink jet head, and each delay section adopts a different delay time from the other.

11. The ink jet printer as in claim 1, wherein the ink jet printer is a line type printer.

* * * * *

UNITED STATES PATENT AND TRADEMARK OFFICE

CERTIFICATE OF CORRECTION

PATENT NO. : 8,038,245 B2
APPLICATION NO. : 11/260162
DATED : October 18, 2011
INVENTOR(S) : Naoto Iwao et al.

It is certified that error appears in the above-identified patent and that said Letters Patent is hereby corrected as shown below:

Cover page, item [57] Abstract, Line 9:
delete "sec" and insert -- second --

Column 27, Claim 1, Line 24:
delete "by the element line" and insert -- according to the element line --

Column 28, Claim 6, Line 30:
delete "fist" and insert -- first --

Column 28, Claim 10, Line 52:
delete "ea" and insert -- each --

Signed and Sealed this
First Day of May, 2012

David J. Kappos

David J. Kappos
*Director of the United States Patent and Trademark Office*